US005908663A

United States Patent [19]

Wang et al.

[11] Patent Number: 5,908,663

[45] Date of Patent: Jun. 1, 1999

[54] TOPICAL CARPET TREATMENT

[75] Inventors: Shou-Lu G. Wang, Woodbury; Lori P. Engle, Stillwater; Steven J. Hamrock, St. Paul; Dong-Wei Zhu, Woodbury; Thomas E. Wood, Stillwater; Steven J. Martin, Shoreview, all of Minn.

[73] Assignee: Minnesota Mining and Manufacturing Company, St. Paul, Minn.

[21] Appl. No.: 08/595,592

[22] Filed: Feb. 1, 1996

[51] Int. Cl.[6] ..... B05D 3/02; B05D 3/12

[52] U.S. Cl. ..... 427/322; 427/393.4; 427/401; 428/96

[58] Field of Search ..... 427/389.9, 393.6, 427/393.4, 397.7; 428/96; 422/401, 322

[56] References Cited

U.S. PATENT DOCUMENTS

| | | | |
|---|---|---|---|
| 2,622,307 | 12/1952 | Cogovan et al. | 28/74 |
| 2,734,835 | 2/1956 | Florio et al. | 117/169 |
| 2,786,787 | 3/1957 | Florio | 117/169 |
| 2,881,146 | 4/1959 | Remer et al. | 260/29.2 |
| 2,928,754 | 3/1960 | Schappel | 106/286 |
| 2,983,625 | 5/1961 | Schappel | 117/76 |
| 3,033,699 | 5/1962 | Aarons et al. | 106/286 |
| 3,382,097 | 5/1968 | Erby et al. . | |
| 3,592,684 | 7/1971 | Smith | 117/102 L |
| 3,620,823 | 11/1971 | Smith | 117/188.8 |
| 3,671,292 | 6/1972 | Hirshfeld et al. | 117/62 |
| 3,901,992 | 8/1975 | Payne et al. | 428/96 |
| 3,912,841 | 10/1975 | Payne et al. | 428/96 |
| 3,916,053 | 10/1975 | Sherman et al. | 428/96 |
| 3,940,359 | 2/1976 | Chambers | 260/29.6 |
| 4,423,113 | 12/1983 | Olive et al. | 428/389 |
| 4,501,591 | 2/1985 | Ucci et al. | 8/495 |
| 4,600,735 | 7/1986 | Larsson et al. | 523/216 |
| 4,822,373 | 4/1989 | Olson et al. | 8/115.6 |
| 4,875,901 | 10/1989 | Payet et al. | 8/115.56 |
| 4,879,180 | 11/1989 | Blyth et al. | 428/395 |
| 4,937,123 | 6/1990 | Chang et al. | 428/96 |
| 5,073,442 | 12/1991 | Knowlton et al. | 428/267 |
| 5,074,883 | 12/1991 | Wang | 8/115.55 |
| 5,084,306 | 1/1992 | McLellan et al. | 427/339.4 |
| 5,098,774 | 3/1992 | Chang | 428/267 |
| 5,182,154 | 1/1993 | Blyth et al. | 428/96 |
| 5,236,818 | 8/1993 | Carlson | 427/393.1 |
| 5,344,751 | 9/1994 | Carlson | 427/397.8 |
| 5,370,919 | 12/1994 | Fieuws et al. | 428/96 |
| 5,558,916 | 9/1996 | Heim et al. | 427/393.4 |

FOREIGN PATENT DOCUMENTS

| | | |
|---|---|---|
| 0 016 658 A2 | 10/1980 | European Pat. Off. . |
| 03269184 A2 | 11/1991 | Japan . |
| 05287671 | 11/1993 | Japan . |
| 1072315 | 6/1967 | United Kingdom . |
| 1097336 | 1/1968 | United Kingdom . |
| 1159124 | 7/1969 | United Kingdom . |
| 1237628 | 6/1971 | United Kingdom . |

OTHER PUBLICATIONS

Nevrekar et al., "Spin Finishes for Synthetic Fibers—Part IV", *Man–Made Textiles In India,* 331–336 (Sep. 1991).

Bajaj et al., "Spin Finishes", *Colourage,* 17–26 (Nov. 16–30, 1987).

Postman, "Spin Finishes Explained", *Textile Research Journal,* vol. 50, No. 7, 444–453 (Jul. 1980).

Kalimova et al., "Surface Modification of Cotton–Lavsan Textiles by Colloidal Silicon", *Izv. Vyssh. Uchebn. Zaved., Tekhnol. Tekst. Prom–sti.,* (2), pp. 65–68, 1987.

Wittkamp, B., "Fiber Protectors: Types, Benefits and Limitations", *Carpet Cleaning Basics, Installation & Cleaning Specialist,* p. 14, no date.

Dupont Data Sheet, Ludox® Colloidal Silica, p. 3, no date.

Iler, Ralph, "Uses of Colloidal Silicas", *The Chemistry of Silica,* John Wiley & Sons, New York, (1979), pp. 415–461.

*Primary Examiner*—Michael Lusignan
*Attorney, Agent, or Firm*—John A. Fortkort

[57] ABSTRACT

A method for treating carpets is provided which obviates the need for scouring. In accordance with the method, an unscoured carpet is treated topically, and by means of a low wet pickup method, with a solution comprising particles of silica or a similar inorganic additive and a fluorochemical or other optional organic additive. Carpets treated in accordance with this method are found to have excellent soil resistance properties which do not decrease noticeably with subsequent wear or cleaning. Furthermore, since the method involves a low wet pickup, the required drying times are significantly reduced as compared to conventional aqueous bath immersion methods.

46 Claims, No Drawings

TOPICAL CARPET TREATMENT

FIELD OF THE INVENTION

The present invention relates generally to carpet treatment compositions, and in particular to a topical treatment system for imparting soil resistance to carpets.

BACKGROUND OF THE INVENTION

Several approaches have been utilized for imparting soil resistance to carpets. One approach involves coating the carpet fibers with particulate inorganic oxides, such as silica. The improvement in soil resistance attained by this method is believed to be due, in part, to the oleophobic surface that the oxide coating presents to potential carpet contaminants. U.S. Pat. No. 2,622,307 (Cogovan et al.), U.S. Pat. No. 2,734,835 (Florio et al.), U.S. Pat. No. 2,786,787 (Florio), U.S. Pat. No. 2,928,754 (Schappel), U.S. Pat. No. 2,983,625 (Schappel), U.S. Pat. No. 2,987,754 (Schappel), U.S. Pat. No. 3,033,699 (Aarons), U.S. Pat. No. 3,671,292 (Hirshfeld et al.), U.S. Pat. No. 3,901,992 (Payne et al.) and U.S. Pat. No. 3,912,841 (Payne et al.) exemplify this technology.

However, many problems have been encountered with use of inorganic oxides on carpets. Such materials tend to adhere poorly to the surface carpet fibers, gradually becoming dislodged over time as the carpet wears or is repeatedly vacuumed or cleaned. This results in a discernible loss in soil resistance of the carpet. Furthermore, the dislodged particles tend to form a fine dusting on the surface of the carpet, thereby detracting from the vibrancy and aesthetic appeal of the carpet.

Many attempts have been made to prevent the disassociation of inorganic oxide particles from carpet fibers. Typically, this is accomplished by coating the treated carpet fibers with a binding agent. The binding agent is usually a material that bonds well to both the inorganic oxide particles and the surface of the carpet fibers. U.S. Pat. No. 2,881,146 (Remer), U.S. Pat. No. 3,916,053 (Sherman et al.), U.S. Pat. No. 3,940,359 (Chambers), U.S. Pat. No. 4,423,113 (Olive et al.), U.S. Pat. No. 4,600,735 (Larsson et al.) and U.S. Pat. No. 5,370,919 (Fieuws et al.) exemplify this technology.

Other attempts to improve the soil resistance of carpets have focused on the carpet manufacturing process itself. Both natural and synthetic carpet fibers contain oil residues on their surfaces at the time they are woven into the carpet. See, e.g., N. Nevrekar, B. Palan, "Spin Finishes for Synthetic Fibres—Part IV", *Man-Made Textiles In India* 331–336 (September 1991). These oil residues, which may be naturally occurring fats or waxes (in the case of wool and other natural fibers) or which may be residual spin finishes or other processing oils added during the manufacturing process (in the case of polypropylene and other synthetic fibers), significantly increase the tendency of the assembled carpet to attract dirt and other organic contaminants.

Consequently, it has become common practice in the art to "scour" carpets, a process which typically involves immersing the finished carpet in a bath of aqueous cleaning solution. The cleaning solution effectively reduces the amount of oil residue on the carpet to a level that does not significantly affect the soil resistance of the carpet. Indeed, it has long been considered essential that spin finishes be easily removable through scouring. See, P. Bajaj, R. Katre, "Spin Finishes", *Colourage* 17–26 (Nov. 16–30, 1987); W. Postman, "Spin Finishes Explained", *Textile Research Journal*, Vol. 50, No. 7 444–453 (July 1980).

One example of the use of scouring is illustrated in U.S. Pat. No. 3,592,684 (Smith) and U.S. Pat. No. 3,620,823 (Smith). There, carpet fibers are rendered soil resistant through treatment with a lubricating agent, silicone, and an inorganic oxide. The carpets are subsequently scoured to remove substantially all of the lubricating agent, while leaving behind a substantial portion of the silicone and inorganic oxide.

However, the immersion techniques involved in scouring carpets are undesirable in that they significantly increase the overall cost of manufacturing a carpet. After a carpet is scoured, it must be carefully dried in an oven or kiln to avoid warping or degradation of the carpet fibers. However, due to the immense effective surface area of a carpet, the carpet often absorbs many times its weight in water during scouring. Consequently, the drying process can be considerable, and consumes a significant amount of energy. This is especially true in the case of high quality carpets, which are usually denser than their lower quality counterparts. In the interim, the increased weight of the wetted carpets makes them very cumbersome to handle. Furthermore, to the extent that toxic solvents and chemicals are used or accumulate in the aqueous bath, the drying process generates a significant amount of air-borne and water-borne pollution. Scouring also frequently induces static problems in the treated carpet.

There is thus a need in the art for an alternative method to scouring that does not require significant drying procedures and times in the treated carpet, but that overcomes the adverse effect of residual oils on soil resistance. Such a method should avoid the dusting and pollution problems encountered with many prior art methods of carpet treatment, while rendering a carpet that has good soil resistance. These and other needs such as repellency of the treated carpet are met by the present invention, as hereinafter disclosed.

SUMMARY OF THE INVENTION

The present invention relates to a method for imparting soil resistance to carpets, and to carpets treated in accordance with the method. Surprisingly, it has been found that the need to scour carpets in order to remove their spin finish and thereby improve their soil resistance may be avoided altogether by treating unscoured carpets topically, and by means of a low wet pickup method, with an aqueous solution or dispersion comprising an inorganic additive and an optional organic additive. Carpets treated in accordance with this method are found to have excellent soil resistance properties which do not decrease noticeably with subsequent wear or cleaning. Furthermore, since the method typically results in a wet pickup by the carpet fibers of less than about 60% by weight, and preferably less than about 15% by weight, the required drying times are significantly reduced as compared to conventional aqueous immersion methods in which the wet pickup is typically about 400% by weight.

Without wishing to be bound by any particular theory, it appears that the residual oils or spin finish on the surface of the carpet fibers are adsorbed into the surfaces of the inorganic additive, where they are no longer able to contribute to the soiling or soiling tendencies of the carpet.

DETAILED DESCRIPTION OF THE PREFERRED EMBODIMENT

In accordance with the method of the present invention, carpet is treated, by means of a low wet pick-up method, with a topical solution or dispersion of an inorganic additive to impart improved soil resistance to the carpet. The method results in a wet pick-up of less than about 60% by weight, and preferably less than about 15% by weight. While binding agents and other organic or inorganic additives can be used along with the inorganic additive to impart additional antisoiling, stain release, repellency, or a softer hand, the inorganic additive of the instant invention is sufficient in itself to impart a dramatic improvement in soil resistance.

The treatment of the present invention may be applied as a mixture, solution, dispersion, or slurry, depending in part on the relative solubilities of the component ingredients. Water is the preferred liquid medium because it is inexpensive, environmentally friendly, non-toxic, and not harmfuil to most carpets and carpet fibers. However, in some applications, water may be replaced, in part or in whole, with one or more other solvents, as when a faster drying time is required, or when it is necessary to solvate a hydrophobic component of the treatment mixture.

Various methods may also be used for applying the mixture of the present invention to carpets or carpet fibers. The individual ingredients of the mixture may be applied simultaneously or consecutively at any convenient point during the manufacture of a carpet, and may also be applied to finished carpets or carpet fibers. The mixture is preferably applied to the carpet or carpet fibers as a topical spray, but can also be applied as a foam, powder, dust, or mist, or by electrostatic methods.

In the preferred embodiment, the inorganic additive, optional organic additive, and any other ingredients used in the treatment are mixed together in an aqueous medium and are applied to a carpet or to carpet fibers as a topical spray or foam. The relative amounts or concentrations of each ingredient in the medium are such that treatment of the carpet or carpet fibers with the mixture necessitates at most a low wet pick-up.

As used herein, the term "oil residue" includes fats or waxes which are naturally occurring on natural fibers such as wool, as well as spin finishes and similar processing oils which are added to natural or synthetic fibers during their manufacture or processing. Some examples of oil residues include mineral oils, vegetable oils, fatty acid esters such as butyl stearate, esters of pentaerythritol, trimethylol propane, or other polyols, triglycerides, coconut oil, sperm oil, animal oils, waxes, polyethers, silicones, and alkoxylated alcohols or acids.

As used herein, the terms "particle" or "particulate" refer to a material in a disperse phase having an average diameter of at least about 2 nm. By contrast, the terms "molecular" or "ionic" are used herein in reference to materials present in a medium as individual molecules or ions, or as molecular or ionic clusters having an average diameter of less than about 2 nm.

INORGANIC ADDITIVES

Various inorganic additives-may be used in conjunction with the present invention. Two important classes of inorganic additives are inorganic oxides and basic metal salts. Among the inorganic oxides, grafted inorganic oxides (i.e., inorganic oxides grafted with functional groups or polymers) are especially useful in some applications.

As used herein, the terms "inorganic oxide" or "metal oxide" are applied to a general class of materials comprising at least one species of metal cation combined with oxygen anions or hydroxyl anions, or mixtures of oxygen and hydroxyl ions. This material can additionally contain water in bound or adsorbed form and can further comprise small amounts, for example less than 5% by weight, stabilized counterions such as sodium ion, carboxylate ion, chloride ion, nitrate ion, or the like. The metal oxide or inorganic oxide material can be in crystalline or amorphous form. Examples representatively include true oxides such as $SiO_2$, $ZrO_2$, $TiO_2$, and $Al_2O_3$, oxyhydroxides such as $\alpha AlO(OH)$, and hydroxides such as $Al(OH)_3$, or titanium, aluminum, or zirconium hydroxide gel particles. Preferably, the inorganic oxide used is stable, inert, nontoxic, and does not adversely affect the color or appearance of the treated carpet For the purposes of the present invention, it is desired that the metal oxides or inorganic oxides be in a very finely divided state. Colloidal dispersions of the metal oxide provide a particularly useful form for use in the present invention. In general, the activity of the metal oxide in the present invention will increase with finer state of subdivision of the particles.

Additionally it has been discovered that another class of materials, that is, basic metal salts, can also impart excellent soil resistance to unscoured carpets when used in a topical manner. Like the metal oxides described above, the basic metal salts also generally comprise a metal cation in chemical combination with oxygen anions or hydroxyl anions or combinations of oxygen anions and hydroxyl anions. However, the basic metal salts further consist of a sufficient amount of acid equivalency to render them soluble in water.

As used herein, the term "basic metal salt" refers to a material which can be empirically described by the formula $M(O)_x(OH)_yX_z$, where M has a valence of n and is selected from the metals Al, Zr, and Ti, X has a valence of m and is the conjugate base of the solubilizing acid, and $2x+y+mz=n$. The acids generally used in the preparation of basic metal salts include strong acids, such as hydrochloric, sulfuric, phosphoric, or nitric acid, or weaker acids such as carbonic or carboxylic acids. For example, in the case where a monovalent conjugate base anion is involved, $2x+y+mz=3$ for aluminum and $2x+y+mz=4$ for titanium and zirconium.

Solutions of these basic metal salts are known to contain polynuclear metal cluster cations, that is, cations consisting of more than one metal ion bound together by oxygen and/or hydroxide ligands. Despite the fact that these cluster cations can be quite large, for example, 1–2 nanometers in diameter, when admixed with a suitable carrier fluid or solvent, for example water, these materials fully dissolve to form a true solution. Surprisingly, despite this solubility in the carrier fluid, these basic metal salts can be used in a manner similar to the particulate metal oxides to impart excellent soil resistance to unscoured carpet.

Methods for synthesizing these basic metal salts are well known in the art and include partial neutralization of a simple metal salt by addition of a base, acid hydrolysis of a metal alkoxide, acid dissolution of a basic metal carbonate, or hydrolysis of a metal salt by ion exchange.

The following inorganic oxides were utilized in the Examples of the present invention:

Nalco™ 1042 Colloidal Silica—a 34% solids (by weight) aqueous colloidal acidic silica sol cation available commercially from Nalco Chemical Co., Naperville, Ill. The sol has an average pH of 2.8–3.2, an average particle size of 20 nm in diameter, an average particle surface area of 150 $m^2/g$, is devoid of metal cationic stabilizers, and has a reported $Na_2O$ content of 0.04%.

Nalco™ 1050 Colloidal Silica—a 50% by weight solids aqueous colloidal silica sol available commercially from Nalco Chemical Co. The sol has a pH of 9, an average particle size of 20 nm in diameter, and an average surface area of 150 $m^2/g$, and includes a sodium stabilizing ion.

Nalco™ 2326 Colloidal Silica—a 15% by weight solids aqueous colloidal silica sol available commercially from Nalco Chemical Co. The sol has a pH of 9, an average particle size of 5 nm in diameter, an average surface area of 600 $m^2/g$, and includes an ammonium stabilizing ion.

Nalco™ 2327 Colloidal Silica—a 40% by weight solids aqueous colloidal silica sol available commercially from Nalco Chemical Co. The sol has a pH of 9, an average particle size of 20 nm in diameter, an average surface area of 150 $m^2/g$, and includes an ammonium stabilizing ion.

Nalco™ 2329 Colloidal Silica—a 40% by weight solids aqueous colloidal silica sol available commercially from Nalco Chemical Co. The sol has a pH of 9, an average particle size of 75 nm in diameter, an average surface area of 40 $m^2/g$, and includes an ammonium stabilizing ion.

Cab-O-Sperse™ S3295 Fumed Silica—a 15% by weight solids aqueous dispersion of fumed silica available commercially from Cabot Corporation, Boyertown, Pa. The dispersion has a pH of 9.5, an average agglomerated primary particle size of 100 nm in diameter, and a primary particle surface area of 325 $m^2/g$, and includes a sodium stabilizing ion.

Ludox™ AS-40 Colloidal Silica—a 40% by weight solids aqueous colloidal silica sol available commercially from E.I. duPont de Nemours & Co., Wilmington, Del. The sol has a pH of 9, an average particle size of 20 nm in diameter, an average surface area of 150 $m^2/g$, and includes an ammonium stabilizing ion.

Nalco™ 1056 Aluminized Silica—a 30% by weight solids aqueous colloidal suspension of aluminized silica particles (26% silica and 4% alumina) available commercially from Nalco Chemical Co. The sol has an average particle size of 20 nm in diameter.

Nalco™ 88SN-126 Colloidal Titanium Dioxide—a 10% by weight solids aqueous dispersion of titanium dioxide available commercially from Nalco Chemical Co. The dispersion has a pH of 9.8 and an average particle size of 5 nm in diameter.

Nalco™ 88SN-123 Colloidal Tin Oxide—a 22% by weight solids aqueous dispersion of tin oxide available commercially from Nalco Chemical Co. The dispersion has a pH of 9.9 and an average particle size of 22 nm in diameter.

Nyacol™ Zr 50\20 Zirconia—a 20% by weight solids aqueous colloidal suspension of zirconium dioxide particles averaging 50 nm in diameter, available commercially from Nyacol, Inc., Ashland, Mass.

Nyacol™ Zr 100\20 Zirconia—a 20% by weight solids aqueous colloidal suspension of zirconium dioxide particles averaging 100 nm in diameter, available commercially from Nyacol, Inc.

The following basic metal salts were utilized in the Examples of the present invention:

Zirconium Oxyacetate—a zirconium oxydiacetate available from Magnesium Elektron, Inc., Flemington, N.J.

Basic Aluminum Salt A—a 15% by weight aqueous solution of basic aluminum salt containing hydrolyzed Al clusters with diameters averaging about 2 nm or less, prepared by the following procedure.

A 2.7M $AlCl_3$ $6H_2O$ aqueous solution was mixed with sufficient urea to provide 1.25 moles of urea per mole of aluminum. After refluxing this mixture for 24 hours, the concentration of the sol was increased by rotoevaporation until a precipitate began to form. The solid was separated by filtration and the filtrate solution was combined with ethanol (volume of ethanol added:sol volume=0.33:1.0). The solution was cooled to about 10° C. to precipitate ammonium chloride and the solid was removed by filtration. Ethanol/water was removed by rotoevaporation and the concentrated sol was again filtered. The final oxide content was about 20% (wt). The sol was diluted to 15% (wt) oxide content prior to use.

Basic Aluminum Salt B—a 15% by weight aqueous colloidal suspension of aluminum hydroxide gel particles averaging about 60 nm in diameter in admixture with a basic aluminum carboxylate, prepared by the following procedure.

The preparation of aluminum formoacetate by digestion of aluminum metal in carboxylic acid mixtures is well known in the art. In this case, aluminum formoacetate having an aluminum/carboxylate ratio of 1 was prepared by digesting aluminum metal in an acetic acid/formic acid mixture under reflux conditions. The resulting aluminum formoacetate solution (9.0% alumina) was mixed with urea so that there was 0.075 moles of urea per mole of aluminum. This solution was refluxed for 1.5 hours in a round bottom flask fitted with a reflux condenser. The reflux condenser was then replaced with a distillation head and the solution was concentrated by distillation for an additional 2.5 hours. The slightly turbid, viscous sol that was produced had an oxide content of about 21% (wt). The sol was diluted to 15% (wt) oxide content prior to use.

The following grafted inorganic oxides were utilized in the Examples of the present invention:

PMAA-1042—Mercapto-functionalized Nalco™ 1042 was prepared using the following procedure. An aqueous dispersion of colloidal silica (1176 g of Nalco™ 1042, 20 nm average particle diameter, 34% solids, pH=3.2) was diluted to 10% total solids with distilled water to give 4000 g total. To this was added 19.6 g (100 mmoles) of (3-mercaptopropyl)trimethoxysilane, MPTMS, (available commercial from Aldrich Chemical Co.). The resulting suspension was heated for 18 hours at 80° C. with stirring to give a translucent, colorless suspension which was used without purification.

The grafting reaction was carried out by diluting the mercapto-functionalized Nalco™ 1042 to 2.5% solids with $H_2O$ and mixing with an equivalent weight of a 2.5% aqueous solution of methacrylic acid (available commercially from Aldrich Chemical Co., inhibitor removed). The resulting mixture was degassed with nitrogen, t-butylhydroperoxide (available commercially from Aldrich Chemical Co.) was added at about 1% based on the weight of the monomer, and the mixture was heated to about 65 to 75° C. The heated mixture was stirred for 16–18 hours.

PMAA-2326 —Mercapto-functionalized Nalco™ 2326 (5 nm diameter particles) was prepared in a similar fashion, by first diluting Nalco™ 2326 to 5% solids and then adjusting the pH of the suspension to about 3.5 with $H_2SO_4$ before addition of the MPTMS.

The grafting reaction with mercapto-functionalized Nalco™ 2326 was carried out in a manner analogous to that used in grafting with mercapto-functionalized Nalco™ 1042.

$H_2N$-2326 —an amino-functionalized silica made by the following procedure.

Nalco™ 2326 (2.6 kg) silica sol was adjusted to pH 4 with acetic acid. In a separate flask, 100 g of aminopropyltrimethoxysilane (available commercially from Aldrich Chemical Co.) was mixed with 100 g of water. This mixture was also adjusted to a pH of 4 and was added to the silica sol. An additional 700 g of water was added and the pH of the resulting mixture was lowered to 3.5 with sulfuric acid. The suspension was then heated to 85° C. overnight (16 hours) with stirring to obtain the product.

Pr-2326—propyl-functionalized silica made by the following procedure.

Nalco™ 2326 silica sol (4.5 kg) was mixed with 34.8 g of propyltrimethoxysilane (available from Aldrich Chemical Co.). The mixture was heated to 85° C. and stirred overnight (16 hours) to obtain the product.

ORGANIC ADDITIVES

Various organic additives may be used in conjunction with the present invention. Such materials may include binding agents, stainblockers, hand improvement additives, or repellent fluorochemicals added to impart improved hand or improved soil, water, or oil repellency to treated carpets. In many applications, a given material may perform more than one of these functions. Thus, for example, it is frequently found that a material that performs as a binding agent also improves the hand of the treated carpet. Also, materials that perform a given function under one set of conditions may no longer perform that function under another set of conditions. Thus, for example, some organic additives that act as a binding agent for silica may do so only at certain ratios of organic additive to silica. Consequently, the categorizations of various organic additives in the present invention are not intended to be limiting as to the ultimate function served by a particular organic additive.

Suitable binding agents for use in the present invention must be capable of promoting good particle-to-particle or particle-to-fiber adhesion. Preferably, the binding agent is a material that will not significantly degrade the feel or "hand" of the treated carpet. Examples of materials which frequently behave as binding agents include higher molecular weight polyethylene glycols and their derivatives, including esters and carboxyfunctionalized polyethylene glycols; and stainblocking polymers, such as sulfonated novolac resins, acrylic resins and styrene/maleic anhydride copolymers. Other specific examples of binding agents useful in the present invention are illustrated in the Examples.

Suitable stainblocking materials useful in the present invention include those materials which impart stain resistance to carpets. These materials include the following:

Polymer I—an aqueous solution of a stainblocking acrylic polymer made using the following procedure.

To a 1-L flask were added 115 g of sodium dodecylbenzene sulfonate and 380 g of water. The mixture was deaerated three times using vacuum/nitrogen and was heated to 93° C. In a separate 100 mL flask, 400 mg of ammonium persulfate was dissolved in 22.1 g of deionized water (Feed A). Using two pumps, Feed A and 68.4 g of methacrylic acid (Feed B) were added simultaneously to the sodium dodecylbenzene sulfonate/water mixture at a rate such that both additions were completed after 3 hours. Stirring was continued for an additional 3 hours at 93° C., at which point the reaction was complete.

3M Brand Stain Release Concentrate FC-657—a 30% solids aqueous solution containing a blend of sulfonated novolac and acrylic resins, available commercially from Minnesota Mining and Manufacturing Company (3M), St. Paul, Minn.

3M Brand Stain Release Concentrate FC-661—a 29.5% solids aqueous solution containing a blend of sulfonated novolac and acrylic resins, available commercially from 3M.

Stain Resist SR-300—a 30% by weight solids aqueous solution containing a styrene/maleic anhydride copolymer and a sulfonated novolac resin, commercially available from E.I. duPont de Nemours & Co., Wilmington, Del.

Generally, repellent fluorochemicals useful in the present invention include any of the fluorochemical compounds and polymers known in the art to impart dry soil resistance and water- and oil-repellency to fibrous substrates, particularly to carpet. These repellent fluorochemical compounds and polymers typically comprise one or more fluorochemical radicals that contain a perfluorinated carbon chain having from 3 to about 20 carbon atoms, more preferably from about 6 to about 14 carbon atoms. These fluorochemical radicals can contain straight chain, branched chain, or cyclic fluorinated allcylene groups or any combination thereof The fluorochemical radicals are preferably free of polymerizable olefinic unsaturation but can optionally contain catenary heteroatoms such as oxygen, divalent or hexavalent sulfur, or nitrogen. Fully fluorinated radicals are preferred, but hydrogen or chlorine atoms may also be present as substituents, although, preferably, no more than one atom of either is present for every two carbon atoms. It is additionally preferred that any fluorochemical radical contain from about 40% to about 80% fluorine by weight, and more preferably, from about 50% to about 78% fluorine by weight. The terminal portion of the radical is preferably fully fluorinated, preferably containing at least 7 fluorine atoms, e.g., $CF_3CF_2CF_2$—, $(CF_3)_2CF$—, $SF_5CF_2$—. Perfluorinated aliphatic groups (i.e., those of the formula $C_nF_{2n+1}$—) are the most preferred fluorochemical radical embodiments.

Representative repellent fluorochemical compounds useful in treatments of the present invention include fluorochemical urethanes, ureas, esters, ethers, alcohols, epoxides, allophanates, amides, amines (and salts thereof), acids (and salts thereof), carbodiimides, guanidines, oxazolidinones, isocyanurates, and biurets. Blends of these compounds are also considered useful. Representative fluorochemical polymers useful in treatments in the present invention include fluorochernical acrylate and substituted acrylate homopolymers or copolymers containing fluorochemical acrylate monomers interpolymerized with monomers free of non-vinylic fluorine such as methyl methacrylate, butyl acrylate, acrylate and methacrylate esters of oxyalkylene and polyoxyalkylene polyol oligomers (e.g., oxyethylene glycol dimethacrylate, polyoxyethylene glycol dimethacrylate, methoxy acrylate, and polyoxyethylene acrylate), glycidyl methacrylate, ethylene, butadiene, styrene, isoprene, chloroprene, vinyl acetate, vinyl chloride, vinylidene chloride, vinylidene fluoride, acrylonitrile, vinyl chloroacetate, vinylpyridine, vinyl alkyl ethers, vinyl alkyl ketones, acrylic acid, methacrylic acid, 2-hydroxyethylacrylate, N-methylolacrylamide, 2-(N,N,N-trimethylammonium)ethyl methacrylate, and 2-acrylamido-2-methylpropanesulfonic acid (AMPS). The relative amounts of various non-vinylic fluorine-free comonomers used are generally selected empirically depending on the fibrous substrate to be treated, the properties desired, and the mode of application onto the fibrous substrate. Useful fluorochernical treatments also include blends of the various repellent fluorochemical polymers described above as well as blends of the aforementioned fluorochemical compounds with these repellent fluorochemical polymers.

Also useful in the present invention as substrate treatments are blends of these repellent fluorochemical compounds and polymers with fluorine-free extender compounds, such as free-radically polymerized polymers and copolymers made from methyl methacrylate, butyl acrylate, acrylate and methacrylate esters of oxyalkylene and polyoxyalkylene polyol oligomers, glycidyl methacrylate, 2-hydroxyethylacrylate, N-methylolacrylamide, and 2-(N,N,N-trimethylammonium) ethyl methacrylate; siloxanes; urethanes, such as blocked isocyanate-containing polymers and oligomers; condensates or precondensates of urea or melamine with formaldehyde; glyoxal resins; condensates of fatty acids with melamine or urea derivatives; condensation of fatty acids with polyamides and their epichlorohydrin adducts; waxes; polyethylene; chlorinated polyethylene; and alkyl ketene dimers. Blends of these fluorine-free extender polymers and compounds are also considered useful in the present invention.

The relative amount of the extender polymers and compounds in the treatment is not critical to the present invention. However, the overall composition of the fluorochemical-containing repellent treatment should contain, relative to the amounts of solids present in the system, at least 3 weight percent, and preferably at least about 5 weight percent, of carbon-bound fluorine in the form of said fluorochemical radical groups. Many fluorochemical-containing repellent treatments, including treatment blends that include fluorine-free extender polymers and compounds such as those described above, are commercially available as ready-made formulations. Such products are sold, for example, as Scotchgard™ brand Carpet Protector manufactured by 3M, and as Zonyl™ brand carpet treatment manufactured by E.I. du Pont de Nemours and Company.

The following are specific repellent fluorochemical compounds which are useful in the present invention.

FC-A—an aqueous fluorochemical urethane repellent treatment made using the following procedure.

To a 3-necked round bottom flask equipped with an overhead stirrer, reflux condenser and nitrogen inlet was added 58.2 g of Desmodur™ N-3300 isocyanate (a trifunctional isocyanate biuret derived from three moles of 1,6-hexamethylene diisocyanate and water, available commercially from Mobay Corp., Pittsburgh, Pa.), 142 g of $C_8F_{17}SO_2N(CH_3)CH_2CH_2OH$, 200 g of methyl isobutyl ketone (MIBK) and 3 drops of stannous octoate catalyst. The mixture was refluxed until the fluorochemical alcohol was consumed as measured by GPC (theoretically consuming 85% of the available isocyanate groups). Then 1.4 g of ethylene glycol and 2 additional drops of stannous octoate were added and the mixture was refluxed again until no isocyanate groups remained as monitored by FTIR.

A surfactant solution was made by heating and mixing 11 g of Siponate™ DS-10 (available commercially from Rhone-Poulenec, Princeton, N.J.) with 475 g of deionized water. This hot aqueous surfactant solution was then added with stirring to the solution of fluorochemical urethane in MIBK, and the resulting emulsion was sonified using a Branson Sonifier™ 450 (available from VWR Scientific). The MIBK solvent was removed under reduced pressure to yield the desired fluorochemical urethane aqueous emulsion, which contained 29.5% (wt) active solids.

FC-B—a fluorochemical adipate ester as described in U.S. Pat. No. 4,264,484, Example 8, formula XVII. The ester was used as a 34% solids emulsion.

FC-C—A cationic fluorochemical acrylate copolymer emulsion, made in the following manner. In an 8-oz (225 mL) glass jar were added 31.5 g of $C_8F_{17}SO_2N(CH_3)C_2H_4OC(O)CH{=}CH_2$ (MeFOSEA), 15.8 g of n-butyl acrylate, 5.3 g of n-butyl methacrylate, 2.1 g of $CH_2{=}C(CH_3)C(O)OC_2H_4N^+(CH_3)_2C_{16}H33$ Br–(made by quaternizing N,N-dimethylaminoethyl methacrylate with 1-bromohexadecane) and 126 g of deionized water. The jar was capped and was placed in a water bath adjusted to 80° C. When the MeFOSEA had all melted, the warm mixture was poured into a 1 qt (0.90 L) container and the contents homogenized for 2 minutes using a Waring™ Blender set at high speed. 120 g of the resultant homogenized mixture was poured into a 4 oz (450 mL) bottle and 0.1 g of Vazo™ V-50 initiator [2,2'-azobis(2-amidinopropane) hydrochloride] (available commercially from Wako Chemicals USA Inc., Richmond, Va.) was added. The 4 oz (450 mL) bottle was then purged with nitrogen, was capped, and was placed in a shaker water bath set at 60° C. for 20 hours. The resulting latex was filtered through a piece of cheesecloth. The filtered latex was 29.1% (wt) solids with an average particle size of 0.15 mμ as measured by a Coulter™ N4MD Submicron Particle Size Analyzer.

FC-D—A nonionic fluorochemical acrylate copolymer emulsion, made in the following manner. In a glass reaction bottle was placed 70 g of $C_8F_{17}SO_2N(CH_3)C_2H_4OC(O)CH{=}CH_2$ (MeFOSEA), 30 g of n-butyl acrylate (BA), 0.20 g of V-50 initiator, 0.20 g of n-octylmercaptan, 163.5 g of deionized water, 70 g of acetone and 9.0 g of Tergitol™ 15-S-30 Nonionic Surfactant (available commercially from Union Carbide Corp.). The bottle was degassed, refilled five times with a blanket of nitrogen, and sealed. The bottle was then placed in a 70° C. bath and tumbled therein for 16 hours to give a nonionic polymer emulsion with 30% (wt) solids. This polymer emulsion was used as is for formulation without further purification.

FC-E—a cationic fluorochemical acrylate copolymer emulsion, prepared under the same conditions as FC-D except that 0.20 g of Sipomer™ Q-6 monomer (available commercially from Rhone-Poulenc Surfactants and Specialties, L.P., Princeton, N.J. and 5.0 g of Ethoquad™ 18/25 Cationic Surfactant (available commercially from Armak Corp.) were used in place of Tergitol™ 15-S-30 Nonionic Surfactant. The resulting 30% (wt) solids nonionic polymer emulsion was used as is for formulation without further purification.

FC-Si—a fluorochemical, water-soluble silane of the approximate structure $C_8F_{17}SO_2N(C_2H_5)CH_2CH_2CH_2Si[O(CH_2CH_2O)_2CH_2]_{2.47}(OCHCH_2)_{0.53}$ as described in Example 3 of U.S. Pat. No. 5,274,159. The fluorosilane was used in a 100% solids form.

FC-170C (Fluorad™ Brand FC-170C Fluorochemical Surfactant)—a 100% (wt) active solids ethoxylated fluorochemical alcohol, available commercially from 3M.

FC-171 (Fluorad™ Brand FC-171 Fluorochemical Surfactant)—a 100% (wt) active solids ethoxylated fluorochemical alcohol, available commercially from 3M.

FC-247 (Scotchgard Brand FC-247 Fabric Protector)—a 26.5% (wt) active solids aqueous treatment containing a fluorochemical acrylate polymer, available commercially from 3M.

FC-364 (3M Brand FC-364 Carpet Protector)—a 21% (wt) active solids aqueous treatment containing an anionic fluorocherncal urethane, available commercially from 3M.

FC-365 (3M Brand FC-365 Carpet Protector)—a 21% (wt) active solids aqueous treatment containing an anionic fluorochernical allophanate as described in U.S. Pat. No. 4,606,73 7, available commercially from 3M.

FC-461 (3M Brand FC-461 Fluorochemical Rainwear Apparel Treatment)—a 30% by weight active solids aqueous treatment containing a fluorochemical acrylate polymer, available commercially from 3M, St. Paul, Minn.

FX-1373M (Scotchgard™ FX-1373M Commercial Carpet Protector)—a 31% (wt) active solids aqueous treatment containing a fluorochemical urethane, available commercially from 3M.

Zonyl™ 1250 Carpet Protector—a 30% by weight active solids aqueous treatment believed to contain a fluorochemical urethane-urea, available commercially from E.I. du Pont de Nemours & Co.

Dyetech™ 97H—a 15.6% (wt) active solids aqueous fluorochemical treatment, believed to contain a fluorochernical acrylate polymer, available commercially from Dyetech Inc., Dalton, Ga.

Hand improving agents suitable for use in the present invention include those materials which impart improved hand to the treated carpet. Some materials which typically fuinction in this capacity are the following:

Carbowa™ P 300 Polyethylene Glycol—an approximately 300 molecular weight polyethylene glycol, commercially available from Union Carbide Corp., Danbury, Conn.

Carbowax™ 600 Polyethylene Glycol—an approximately 600 molecular weight polyethylene glycol, commercially available from Union Carbide Corp.

Carbowax™ 3350 Polyethylene Glycol—an approximately 3350 molecular weight polyethylene glycol, commercially available from Union Carbide Corp.

Carbowax™ 8000 Polyethylene Glycol—an approximately 8000 molecular weight polyethylene glycol, commercially available from Union Carbide Corp.

Carbowax™ 25000 Polyoxyethylene—an approximately 25000 molecular weight polyethylene glycol, commercially available from Union Carbide Corp.

Emerest™ 2662 Polyethylene Glycol 600 Monostearate—100% solids product, available commercially from Henkel Corp., Mauldin, S.C.

PEGDA—600 molecular weight polyethylene glycol bis (carboxymethyl ether), available commercially from Aldrich Chemical Co. as Catalogue No. 40,703-8.

Various other organic additives useful in the present invention include the following:

Berol™ 09 Surfactant—a 100% solids ethoxylated nonylphenol, commercially available from Akzo Nobel Surface Chemistry, Inc., Stratford, Conn.

Spensol™ L-55 Urethane—a 35% (wt) aqueous solution of a water-soluble urethane, available commercially from Reichhold Corp., Research Triangle Park, N.C.

Rhoplex™ HG-74 Acrylic—a 42% (wt) solids aqueous emulsion of an acrylic copolymer available commercially from Rohm & Haas Co., Philadelphia, Pa.

Adcote™ 50T-4990 Acrylic—a 35% (wt) solids aqueous dispersion of an ethylene/acrylic acid copolymer, available commercially from Morton International, Chicago, Ill.

Neocryl™ A-601 Acrylic—a 32% (wt) acrylic latex, available commercially from ICI Americas, Inc., Wilmington, Del.

NeoRez™ XR-9699 Urethane—a 40% (wt) solids aqueous dispersion of a urethane polymer, available commercially from ICI Americas, Inc.

NeoCryl™ A-6092 Acrylic—a 43% (wt) solids aqueous dispersion of an acrylic polymer, available commercially from ICI Americas, Inc.

NeoCryl™ XA-6075 Acrylic—a 45% (wt) solids aqueous dispersion of an acrylic polymer, available commercially from ICI Americas, Inc.

PVA #1—98% hydrolyzed polyvinyl alcohol having a molecular weight distribution of from 13000 to 23000, commercially available from Aldrich Chemical Co.

PVA #2—98–99% hydrolyzed polyvinyl alcohol having a molecular weight distribution of from 31000 to 50000, commercially available from Aldrich Chemical Co.

CARPETS

The method of the present invention may be used to treat a wide variety of carpet materials, including polypropylene, nylon, acrylic, and wool carpets. The treatment of the following specific carpets is illustrated in the Examples.

Dignitary™ 51609 Carpet—a polypropylene carpet, available commercially from Shaw Industries, Inc., Dalton, Ga. The carpet is characterized by a 100% cut pile and a face weight of 55–60 oz/yd$^2$ (1.9–2.1 kg/m$^2$). The color of the carpet is designated by the color code 09100. The unscoured carpet contains about 0.5–1.1% by weight of spin finish. The scoured carpet contains about 0.02–0.26% by weight of spin finish.

Zeftron™ 2000 Carpet—a solution-dyed nylon carpet, made for 3M by BASF Corp., Parsippany, N.J. The carpet is made of yarn type 1115, #6104, and is characterized by a level loop style and a face weight of 38 oz/yd$^2$ (1.3 kg/m2). The color of the carpet is citrine. The unscoured carpet contains approximately 0.8% by weight of spin finish, and the scoured carpet contains about 0.02% by weight of spin finish.

Style "Angelic™" Carpet—a carpet available commercially from Horizon Mohawk Industries, Calhoun, Ga., made of 100% 1800/99 solution-dyed nylon fiber from BASF Corp. The carpet is made of the same polymer with the same fiber cross-section and spin finish as Zeftron™ 2000, tri-level loop construction, face weight of 28 oz/yd$^2$ (0.9 kg/m$^2$). The color of the carpet is off-white. The unscoured carpet contains approximately 1.4% by weight spin finish and the scoured carpet contains approximately 0.06% by weight spin finish.

Acrylan™ Carpet—an acrylic carpet available commercially from Monsanto Corp., St. Louis, Mo. The carpet is characterized by a level loop style and a face weight of 40 oz/yd$^2$ (1.3 kg/m$^2$). The color of the carpet is off-white. The unscoured carpet contains approximately 0.63–1.30% by weight of spin finish. The scoured carpet contains approximately 0.01% by weight of spin finish.

Style M0033 Carpet—a polypropylene carpet, "Classic Weave" style #A3493, available commercially from Shaw Industries, Inc. The carpet is characterized by a loop pile style and a face weight of 40 oz/yd$^2$ (1.3 kg/m$^2$). The unscoured carpet contains about 0.48% by weight of spin finish. The scoured carpet contains about 0.03% by weight of spin finish.

Regal Heir™ Carpet—a polypropylene carpet, Style 17196, available from Shaw Industries, Inc. The unscoured carpet contains approximately 0.66% (wt) of spin finish on the fibers and is characterized by a Berber style and a face weight of 49 oz/yd$^2$ (1.7 kg/m$^2$). The scoured carpet contains approximately 0.13% (wt) of spin finish on the fibers. The color of the carpet is sand dollar and is designated by the color code 96100.

CM010 Carpet—a wool carpet, cobblestone Style No. CM010, available from Shaw Industries, Inc. The unscoured carpet contains approximately 0.85% spin finish (believed to be a combination of natural and synthetic oils) and is characterized by a level loop style and a face weight of 44 oz/yd$^2$ (1.5 kg/m$^2$). The scoured carpet contains approximately 0.14% spin finish. The color of the carpet is sand dollar and is designated by the color code 96100.

TEST PROCEDURES

The following procedures were used in the Examples of the present invention:

Determining Percent Lubricant on Carpet—The weight percent of lubricant on unscoured or scoured carpet was determined in accordance with the following test procedure.

A 9.3 g carpet sample is placed in an 8 oz (225 mL) glass jar along with 90 g of solvent (typically, ethyl acetate or methanol). The glass jar is capped and is mounted on a tumbler for 10 minutes. Next, 50 g of the solvent containing the stripped lubricant is poured into a tared aluminum pan which is placed in a 250° F. (121° C.) vented oven for 20 minutes to remove the solvent. The pan is then reweighed to determine the amount of lubricant present. The percent lubricant on the carpet is calculated by dividing the weight of lubricant by the initial weight of the carpet sample and dividing by 100.

Scouring of Carpet—Scouring of the carpet to remove lubricant can be accomplished by washing the carpet thoroughly with hot water containing detergent, followed by rinsing.

Spray Application and Curing Procedure—The aqueous treatment is applied to the carpet via spraying to about 15% by weight wet pickup. The amount of inorganic additive and optional hydrophilic polymer to be added to the aqueous treatment solution is determined by the theoretical percent solids on carpet (expressed as "% SOC") desired. Unless specified otherwise, the wet sprayed carpet is then dried at 120° C. until dry (typically 10–20 minutes) in a forced air oven to cure the treatment onto the carpet.

Foam Application and Curing Procedure—The foamer used in the present invention consists of a foam preparation device and a vacuum frame device.

The foam preparation device is a Hobart Kitchen-Aid™ made by the Kitchen-Aid Division of Hobart Corporation, Troy, Ohio.

The vacuum frame device is a small stainless steel bench with a vacuum plenum and a vacuum bed. The carpet to be treated is placed on the bed, along with the foamed material to be deposited onto the carpet. The vacuum bed forms a bench that has an exhaust port fitted to a Dayton Tradesman™ 25 gallon Heavy Duty Shop Vac. The size of the bed is 8"×12"×1.5". The plenum is separated from the rest of the bed by an aluminum plate in which closely spaced 1/16" holes are drilled. The plate is similar in structure to a colander.

The portion of carpet to be treated is weighed. The carpet may then be pre-wetted with water. Several parameters of the application must be adjusted by trial and error. In particular, trial foams must be prepared in order to determine the blow ratio, which is determined by the equation $$\text{blow ratio}=\text{foam volume}/\text{foam weight}$$

In general, the foam should be adjusted so that the wet pick-up of foam is about 60% that of the dry carpet weight. A doctor blade can be prepared out of any thin, stiff material. Thin vinyl sheeting, approximately 100 mils thick, is especially suitable, since it can be cut easily to any size. The notch part of the blade should be about 8" wide so as to fit into the slot of the vacuum bed.

In a typical application, about 150 g of liquid to be foamed is put into the bowl of the Kitchen-Aid™. The wire whisk attachment is used and the mixer is set to its highest speed (10). About 2–3 minutes are allowed for the foam to form and stabilize at a certain blow ratio. The blow ratio may be calculated by placing volume marks on the side of the bowl.

An excess of the foam is placed on top of the carpet specimen resting flat on the vacuum bed. Caution must be exercised so that there are no large air pockets in the foam structure. The foam is then doctored off with the doctor blade. The vacuum is then subsequently turned on and pulled into the carpet. At this point, the carpet may be oven dried.

"Walk-On" Soiling Test—The relative resistance of the treated carpet to dry soiling is determined by challenging both treated unscoured and untreated scoured (control) carpet under defined "walk-on" soiling conditions and comparing their relative soiling levels. The defined soil condition test is conducted by mounting treated and control small square carpet samples on particle board panels (typically five to seven replicates of each), placing the panels on the floor at a high pedestrian location, and allowing the samples to be soiled by normal foot traffic. The amount of foot traffic in each of these areas is monitored, and the position of each sample within a given location is changed daily using a pattern designed to minimize the effects of position and orientation upon soiling.

Following a period of one cycle of walk-on traffic followed by vacuuming, where one cycle is defined as approximately 10,000 foot-traffics, soiled carpet samples are removed and the amount of soil present on a given sample is determined using colorimetric measurements, making the assumption that the amount of soil on a given sample is directly proportional to the difference in color between the unsoiled sample and the corresponding sample after soiling. The three CIE L*a*b* color coordinates of the soiled carpet samples are measured using a Minolta 310 Chroma Meter with a D65 illumination source. The color difference value, ΔE, of each soiled carpet sample is calculated relative to its unsoiled counterpart (i.e., carpet which has not been walked upon) using the equation $$\Delta E=[(\Delta L^*)^2+(\Delta a^*)^2+(\Delta b^*)^2]^{1/2}$$

where $\Delta L^*=L^*\text{soiled(treated)}-L^*\text{unsoiled(control)}$ $\Delta a^*=a^*\text{soiled(treated)}-a^*\text{unsoiled(control)}$ $\Delta b^*=b^*\text{soiled(treated)}-b^*\text{unsoiled(control)}$ The ΔE values calculated from these colorometric measurements have been shown to be qualitatively in agreement with values from older, visual evaluations such as the soiling evaluation suggested by the American Associates of Textile Chemists and Colorists (AATCC), and have the additional advantages of higher precision and being unaffected by environment variations or operator subjectivities. Typical, the 95% confidence interval when using five to seven replicates is about ±1 ΔE unit.

A ΔΔE value is also calculated, which is a "relative ΔE" value obtained by subtracting from the ΔE value of the soiled treated unscoured carpet sample the ΔE value measured for a soiled untreated scoured carpet sample. The lower the ΔΔE value, the better the soil resistance of the treatment. A negative ΔΔE value means that the treated unscoured carpet is more resistant to soiling than is untreated scoured carpet.

Hand Test—An unsoiled treated carpet sample is evaluated for hand by rubbing a hand over the carpet surface and noting the relative softness of the carpet fibers. The hand of a carpet is sometimes directly affected by the degree of adherence of the inorganic additive to the carpet fibers. Thus, when adherence is poor, the resulting dustiness or sandiness imparted by loose particles of the inorganic additive may adversely affect the hand of the carpet. On the other hand, in some cases, hand may be poor even when the adherence of the inorganic additive to the carpet fibers is good.

Oil Repellency Test—Treated carpet samples were evaluated for oil repellency using 3M Oil Repellency Test III February 1994), available from 3M. In this test, treated carpet samples are challenged to penetration by oil or oil mixtures of varying surface tensions. Oils and oil mixtures are given a rating corresponding to the following:

| Oil Repellency Rating Number | Oil Composition |
|---|---|
| F | (fails mineral oil) |
| 1 | mineral oil |
| 1.5 | 85/15 (vol) mineral oil |
| 2 | 65/35 (vol) mineral oil with n-hexadecane |
| 3 | n-hexadecane |

In running this test, a treated carpet sample is placed on a flat, horizontal surface and the carpet pile is hand-brushed in the direction giving the greatest lay to the yarn. Five small drops of an oil or oil mixture are gently placed at points at least two inches apart on the carpet sample. If, after observing for ten seconds at a 45° is angle, four of the five drops are visible as a sphere or a hemisphere, the carpet is deemed to pass the test for that oil or oil mixture. The reported oil repellency rating corresponds to the most penetrating oil (i.e., the highest numbered oil in the above table) for which the treated carpet sample passes the described test. A "+" following the number indicates that the repellency was slightly higher than the reported number, while a "−" following the number indicates that the repellency was slightly lower than the reported number.

Water Repellency Test—Treated carpet samples were evaluated for water repellency using 3M Water Repellency Test V for Floorcoverings (February 1994), available from 3M. In this test, treated carpet samples are challenged to penetrations by blends of deionized water and isopropyl alcohol (IPA). Each blend is assigned a rating number as shown below:

| Water Repellency Rating Number | Water/IPA Blend (% by volume) |
|---|---|
| F | (fails water) |
| W | 100% water |
| 1 | 90/10 water/IPA |
| 2 | 80/20 water/IPA |

The Water Repellency Test is run in the same manner as is the Oil Repellency Test, with the reported water repellency rating corresponding to the highest IPA-containing blend for which the treated carpet sample passes the test. A "+" or a "−" following the reported number has the same significance as in the Oil Repellency Test.

Shampooing and Steam Cleaning Procedure—The shampooing and steam cleaning procedure used is described in the publication "Shampooing Carpet Samples with Carpet Board Cleaning Machine," *Floorcovering Test Methods*, CPT 106-1995 (Apr. 21, 1995), available from 3M. This test method describes the use of an automatic laboratory carpet board cleaning machine designed to reproduce approximately the shampooing of carpets through a hot water extraction process. Hot water (at 140° F. or 60° C.) is used during all of the testing.

The machine has three stations with a spray nozzle and vacuum cleaner head at each station. The first station sprays soap solution onto the carpet samples immediately preceding a vacuum head that moves slowly over the surface of the carpet. The other two stations spray only water for rinsing immediately in front of the vacuum head as it passes over the carpet, removing as much rinse water as possible. A turntable carries the boards with the carpet samples to each station, rotating the samples 90° between stations.

A metering pump delivers the soap from a soap reservoir into the water line connected to the first head. The soap in the reservoir contains a 1:1 mixture of water and Steamex™ Super Carpet Cleaner, available commercially from U.S. Floor Systems, Inc., Raleigh, N.C. The metering pump delivers a concentration of 1 oz (28 g) of soap to 1 gal (3.8 L) of water to make the soap solution.

After shampooing and steaming, the wet carpet samples are allowed to dry flat at room temperature with the pile up. After drying, the carpet samples are subjected to the repellency, soiling, and staining challenges previously described.

EXAMPLES 1–4 AND COMPARATIVE EXAMPLES C1–C6

The following Examples illustrate the soil resistance values of unscoured polypropylene carpet treated in accordance with the method of the present invention. Those values are compared with the soil resistance values of similarly treated scoured samples of the same carpet. These Examples also illustrate the effect of the surface area of the inorganic particles on the soil resistance values.

In Examples 1–4 and Comparative Examples C2–C5, treatments containing colloidal silica with particle sizes of about 75 nm and surface areas ranging from 40–600 $m^2/g$ were applied to unscoured and scoured Dignitary™ 51609 polypropylene carpet samples using the Spray Application and Curing Procedure, and the effect of each treatment on the soiling value of the carpet was measured using one cycle of the "Walk-On" Soiling Test.

In Examples 1–4, aqueous treatments containing Nalco™ 2329 Colloidal Silica, Nalco™ 2327 Colloidal Silica, Cab-O-Sperselm S3295 Fumed Silica, and Nalco™ 2326 Colloidal Silica, respectively, were applied to unscoured carpet at 0.75% SOC.

In Comparative Example C1, no treatment was applied to unscoured carpet.

In Comparative Examples C2–C5, the same treating and soiling test procedures were followed as described in Examples 1–4, respectively, except that the aqueous colloidal silica treatments were applied to scoured rather than unscoured carpet.

In Comparative Example C6, no treatment was applied to scoured carpet.

The ΔE and ΔΔE values for Examples 1–4 and Comparative Examples C1–C6 are presented in. By definition, the ΔΔE value for Comparative Example C6 was set equal to zero.

TABLE 1

| Ex. | Carpet Scoured? | Coll. Silica | Particle/ Agglomerate Size (nm) | Particle/ Agglomerate Area($m^2/g$) | % SOC Applied | Soiling Values: ΔE | ΔΔE |
|---|---|---|---|---|---|---|---|
| 1 | No | 2329 | 75 | 40* | 0.75 | 15.21 | 4.94 |
| 2 | No | 2327 | 20 | 150* | 0.75 | 12.96 | 2.69 |
| 3 | No | S3295 | 100 | 325** | 0.75 | 11.39 | 1.12 |
| 4 | No | 2326 | 5 | 600* | 0.75 | 10.81 | 0.55 |
| C1 | No | — | — | — | — | 18.68 | 8.83 |
| C2 | Yes | 2329 | 75 | 40* | 0.75 | 7.70 | — 1.73 |
| C3 | Yes | 2327 | 20 | 150* | 0.75 | 8.63 | 0.79 |
| C4 | Yes | S3295 | 100 | 325** | 0.75 | 8.55 | — 0.88 |
| C5 | Yes | 2326 | 5 | 600* | 0.75 | 10.01 | — 0.59 |
| C6 | Yes | — | — | — | — | 9.84 | 0 |

*Particle/agglomerate surface area was determined using the Sears Method based on the titration of the surface silanols as described in Analytical Chemistry, Vol. 28, 1981 (1956).

**Particle/agglomerate surface area was determined by Nitrogen Adsorption Capacity using the Brunauer Emmett-Teller (BET) procedure as described in Annual Book of ASTM Standards, Vol. 09.01, Designation D1993–91, 360–365 (1993).

The ΔΔE values in Table 1 show that the application of aqueous colloidal silica treatment to unscoured polypropylene carpet greatly improved its anti-soiling performance (Examples 1–4 compared to Comparative Example C1). This improvement was most dramatic when the average size of the colloidal silica particles was very small, i.e., when the particles had a surface area of 300 $m^2/g$ or more. In Example 4, the anti-soiling performance of treated unscoured carpet was nearly comparable to that of scoured untreated carpet (Comparative Example C6). In Example 3, though the silica particles were large in size, anti-soiling performance was still very good, as each larger particle was comprised of agglomerated primary silica particles, each primary particle having a large surface area to volume ratio.

In contrast, when the aqueous colloidal silica treatments were applied to scoured polypropylene carpet (Comparative Examples C2–C5), the improvements in anti-soiling performance as compared to untreated scoured polypropylene carpet (Comparative Example C6) were relatively small.

EXAMPLES 5–12 AND COMPARATIVE EXAMPLES C7–C16

The following Examples illustrate the use of various inorganic additives in the method of the present invention.

In Examples 5–12 and Comparative Examples C8–C15, unscoured and scoured samples of Dignitary™ 51609 polypropylene carpet were treated with aqueous colloidal dispersions of various metal oxides and basic metal salts using the Spray Application and Curing Procedure, and the effect of each treatment on the soiling value of the carpet was measured using the "Walk-On" Soiling Test.

In Examples 5–12, metal oxide sols containing Basic Aluminum Salts A and B, Nalco™ 1056 Aluminized Silica, Nyacol™ Zr 50\20 and 100\20 Zirconias, Zirconium Oxyacetate, Nalco™ 88SN-126 Colloidal Titanium Dioxide and Nalco™ 88SN-123 Colloidal Tin Oxide, respectively, were applied to unscoured carpet at 0.75% SOC.

In Comparative Example C7, no treatment was applied to unscoured carpet.

In Comparative Examples C8–C1 5, the same treating and soiling test procedures were followed as described in Examples 5–12, respectively, except that the aqueous colloidal metal oxide treatments were applied to scoured rather than unscoured carpet.

In Comparative Example C16, no treatment was applied to the scoured carpet.

The ΔE and ΔΔE values for Examples 5–12 and Comparative Examples C7–C16 are presented in Table 2. By definition, the ΔΔE value for Comparative Example C16 was zero.

The ΔΔE values in Table 2 show that treatment of unscoured polypropylene carpet with basic aluminum salts, aluminized silica, zirconium dioxide, zirconium oxyacetate, titanium dioxide and tin oxide sols (Examples 5–12) greatly enhanced the anti-soiling performance of the carpet when compared to the performance of untreated carpet (Comparative Example C7). The effect was especially pronounced when solutions of basic metal salts which form polynuclear metal clusters were used (Examples 5 and 10).

In contrast, when colloidal treatments containing inorganic oxides or basic metal salts were applied to scoured polypropylene carpet (Comparative Examples C8–C15), the improvement in anti-soiling performance compared to untreated scoured carpet (Comparative Example C16) was relatively small or nonexistent.

EXAMPLES 13–15 AND COMPARATIVE EXAMPLES C17–C21

The following Examples illustrate the effect of the choice of counterion on the antisoiling behavior of various colloidal silicas used to treat carpet in accordance with the method of the present invention.

In Examples 13–15 and Comparative Examples C18–C20, unscoured and scoured samples of Dignitary™ 51609 polypropylene carpet were treated with colloidal silica having ammonium and sodium stabilizing ions (Nalco™ 2327 and Nalco™ 1050 Colloidal Silicas, respectively) and acid silica sols having no stabilizing ion (Nalco™ 1042 Colloidal Silica). The colloidal silicas were applied using the Spray Application and Curing Procedure, and the effect of each treatment on the soiling value of the carpet was measured using one cycle of the "Walk-On" Soiling Test.

In Examples 13–15, aqueous treatments containing Nalco™ 1042, Nalco™ 2327 and Nalco™ 1050 Colloidal Silicas, supplied at pHs of 3, 9, and 9, respectively, were applied to unscoured carpet at 0.75% SOC.

In Comparative Example C17, no treatment was applied to unscoured carpet.

In Comparative Examples C18–C20, the same treating and soiling test procedures were followed as described in

TABLE 2

| Ex. | Carpet Scoured? | Particle Composition | Metal Sol | Particle Size (nm) | % SOC Applied | Soiling Values: ΔE | ΔΔE |
|---|---|---|---|---|---|---|---|
| 5 | No | $Al_2O_3$ | Salt A | 2 | 0.75 | 10.63 | 0.36 |
| 6 | No | $Al_2O_3$ | Salt B | 60 | 0.75 | 11.97 | 1.70 |
| 7 | No | $Al_2O_3 + SiO_2$ | 1056 | 20 | 0.75 | — | 2.19 |
| 8 | No | $ZrO_2$ | Zr50\20 | 50 | 0.75 | 13.28 | 3.01 |
| 9 | No | $ZrO_2$ | Zr100\20 | 100 | 0.75 | 13.21 | 2.94 |
| 10 | No | $ZrOAc_2$ | — | molecular | 0.75 | 10.30 | 0.03 |
| 11 | No | $TiO_2$ | 88SN-126 | 5 | 0.75 | 12.38 | 2.53 |
| 12 | No | SnO | 88SN-123 | 22 | 0.75 | 13.88 | 4.03 |
| C7 | No | — | — | — | — | 18.68 | 8.83 |
| C8 | Yes | $Al_2O_3$ | Salt A | 2 | 0.75 | 9.09 | −0.33 |
| C9 | Yes | $Al_2O_3$ | Salt B | 60 | 0.75 | 8.25 | −1.71 |
| C10 | Yes | $Al_2O_3 + SiO_2$ | 1056 | 20 | 0.75 | — | −0.69 |
| C11 | Yes | $ZrO_2$ | Zr50\20 | 50 | 0.75 | 9.84 | 0.41 |
| C12 | Yes | $ZrO_2$ | Zr100\20 | 100 | 0.75 | 9.53 | 0.11 |
| C13 | Yes | $ZrOAc_2$ | — | molecular | 0.75 | 8.50 | −0.93 |
| C14 | Yes | $TiO_2$ | 88SN-126 | 5 | 0.75 | 10.95 | 1.10 |
| C15 | Yes | SnO | 88SN-123 | 22 | 0.75 | 10.90 | 1.05 |
| C16 | Yes | — | — | — | — | 9.85 | 0 |

Examples 13–15, respectively, except that the aqueous colloidal metal oxide treatments were applied to scoured rather than unscoured carpet.

In Comparative Example C20, no treatment was applied to scoured carpet.

The ΔE and ΔΔE values for Examples 13–15 and Comparative Examples C17–C21 are presented in Table 3. By definition, the ΔΔE value for Comparative Example C21 was zero.

TABLE 3

| Ex. | Carpet Scoured? | Silica Sol | pH | Stabilizing Ion | % SOC Applied | Soiling Values: ΔE | ΔΔE |
|---|---|---|---|---|---|---|---|
| 13 | No | 1042 | 4 | none | 0.75 | 18.05 | 4.11 |
| 14 | No | 2327 | 9 | $NH_4^+$ | 0.75 | 18.26 | 4.32 |
| 15 | No | 1050 | 9 | $Na^+$ | 0.75 | 20.76 | 6.82 |
| C17 | No | — | — | — | — | 24.07 | 10.13 |
| C18 | Yes | 1042 | 4 | none | 0.75 | 11.34 | −2.60 |
| C19 | Yes | 2327 | 9 | $NH_4^+$ | 0.75 | 16.64 | 2.70 |
| C20 | Yes | 1050 | 9 | $Na^+$ | 0.75 | 14.73 | 0.79 |
| C21 | Yes | — | — | — | — | 13.94 | 0 |

The ΔΔE values in Table 3 show that, on unscoured polypropylene carpet, better anti-soiling performance was realized with the silica sols stabilized with ammonium ion or acid silica sols (Examples 13 and 14) than with the sols stabilized with sodium ion (Example 15), although all three treatments gave greatly improved anti-soiling performance when compared to no treatment (Comparative Example C17). When applied to scoured carpet (Comparative Examples C18–C20), the silica treatments had no clear positive or negative overall effect on anti-soiling characteristics when compared to untreated scoured carpet (Comparative Example C21).

EXAMPLES 16–18 AND COMPARATIVE EXAMPLES C22–C26

The following Examples illustrate the effect of the method of the present invention in treating various kinds of carpet.

In Examples 16–18, unscoured solution-dyed nylon carpet, acrylic carpet and wool carpet were treated with colloidal silica using the Spray Application and Curing Procedure. The soiling value for each treated carpet was measured using one cycle of the "Walk-On" Soiling Test.

In Examples 16–18, aqueous treatments containing Nalco™ 2326 Colloidal Silica were applied to unscoured samples of Zeftron™ 2000 Carpet (solution-dyed nylon), Acrylan™ acrylic carpet, and CM010 wool carpet, respectively, at 0.75% SOC.

In Comparative Examples C22, C24 and C26, no treatment was applied to the same unscoured carpets of Examples 16–18, respectively.

In Comparative Examples C23 and C25, no treatment was applied to the scoured, solution-dyed nylon and wool carpets.

The ΔE and ΔΔE values for Examples 16–18 and Comparative Examples C22–C26 are presented in Table 4. By definition, the ΔΔE values for Comparative Examples C23 and C25 were set equal to zero.

TABLE 4

| Ex. | Carpet Scoured? | Carpet Substrate | % Silica (SOC) | Soiling values: ΔE | ΔΔE |
|---|---|---|---|---|---|
| 16 | No | Nylon | 0.75 | 5.36 | −0.15 |
| C22 | No | Nylon | — | 13.70 | 8.49 |
| C23 | Yes | Nylon | — | 5.21 | 0 |
| 17 | No | Wool | 0.75 | 1.60 | −0.73 |
| C24 | No | Wool | — | 4.08 | 1.75 |
| C25 | Yes | Wool | — | 2.33 | 0 |
| 18 | No | Acrylic | 0.75 | 2.45 | — |
| C26 | No | Acrylic | — | 10.14 | — |

The ΔΔE values in Table 4 show that when the aqueous silica sol treatment was applied to unscoured nylon carpet, the anti-soiling value of the treated carpet (Example 16) was greatly improved over that of the untreated, unscoured nylon carpet (Comparative Example C22) and was essentially comparable to the value measured on untreated scoured nylon carpet (Comparative Example C23).

A similar large improvement in anti-soiling value resulted upon comparing treated unscoured acrylic carpet (Example 18) to untreated unscoured acrylic carpet (Comparative Example C26). The effect with wool carpet was also evident but less dramatic (Example 17 vs. Comparative Examples C24 and C25).

EXAMPLES 19–31 AND COMPARATIVE EXAMPLES C27–C32

The following Examples illustrate the effect of treating unscoured carpet with colloidal silica and a stainblocking polymer.

In Examples 19–31, unscoured samples of Dignitary™ 51609 Carpet (polypropylene) were treated with colloidal silica alone, various stainblocking polymers alone, and blends thereof using the Spray Application and Curing Procedure. The soiling value for each treated carpet sample was determined using one cycle of the "Walk-On" Soiling Test, and the adherence of each treatment to the carpet was measured using the Treatment Adherence Test.

In Examples 19–21, Nalco™ 2326 Colloidal Silica was applied alone at levels of 0.90, 0.75 and 0.50% SOC at a treatment pH of 9.

In Examples 22–29, 3M Brand Stain Release Concentrate FC-661 was coapplied at levels varying from 0.125–0.75% SOC with Nalco™ 2326 Colloidal Silica at levels varying from 0.15–0.75% SOC. Treatment pHs varied from 4 to 6.

In Examples 28 and 29, 3M Brand Stain Release Concentrate FC-657 was coapplied at levels of 0.125 and 0.25% SOC with Nalco™ 2326 Colloidal Silica at 0.50% SOC. Treatment pHs were 5 and 4, respectively.

In Examples 30 and 31, Stain Resist SR-300 was coapplied at levels of 0.125% and 0.25% SOC, respectively, with Nalco™ 2326 Colloidal Silica at 0.50% SOC. Treatment pHs were 8 and 7 respectively.

In Comparative Examples C28–C30, FC-661, FC-657 and SR-300, respectively, were applied alone at 0.25% SOC, while in Comparative Example C27, FC-661 was applied alone at 0.90% SOC.

In Comparative Example C31, no treatment was applied to unscoured carpet.

In Comparative Example C32, no treatment was applied to scoured carpet.

The ΔE and ΔΔE values for Examples 19–31 and Comparative Examples C27–C32 are presented in Table 5. By definition, the ΔΔE value for Comparative Examples C32 as set equal to zero.

TABLE 5

| Ex. | Carpet Scoured? | 2326, % SOC | Polymer: Name | Polymer: % SOC | pH | Soiling, ΔΔE |
|---|---|---|---|---|---|---|
| 19 | No | 0.90 | — | — | 9 | 0.56 |
| 20 | No | 0.75 | — | — | 9 | 2.17 |
| 21 | No | 0.50 | — | — | 9 | 3.51 |
| 22 | No | 0.50 | FC-661 | 0.125 | 5 | 1.32 |
| 23 | No | 0.50 | FC-661 | 0.25 | 5 | 1.69 |
| 24 | No | 0.75 | FC-661 | 0.15 | 6 | −1.37 |
| 25 | No | 0.45 | FC-661 | 0.45 | 5 | 1.01 |
| 26 | No | 0.15 | FC-661 | 0.75 | 4 | 2.40 |
| 27 | No | 0.60 | FC-661 | 0.15 | 5 | −1.22 |
| 28 | No | 0.50 | FC-657 | 0.125 | 5 | 1.68 |
| 29 | No | 0.50 | FC-657 | 0.25 | 4 | 1.45 |
| 30 | No | 0.50 | SR-300 | 0.125 | 5 | 1.31 |
| 31 | No | 0.50 | SR-300 | 0.25 | 4 | 1.98 |
| C27 | No | — | FC-661 | 0.90 | 3 | 3.64 |
| C28 | No | — | FC-661 | 0.25 | 3 | 5.87 |
| C29 | No | — | FC-657 | 0.25 | 3 | 8.86 |
| C30 | No | — | SR-300 | 0.25 | 3 | 7.50 |
| C31 | No | — | — | — | — | 11.26 |
| C32 | Yes | — | — | — | — | 0 |

The hand of the samples tested was generally "good", with the exceptions of Examples 19–20, which had a comparatively large amount of silica (greater than 0.5%) and no polymer. The data in Table 5 show that when each of the stainblocking polymers was coapplied with colloidal silica, improved anti-soiling and better hand were both generally achieved. Anti-soiling results from Examples 24 and 27, using relatively high ratios of silica to polymer, were especially impressive, out performing soiled untreated scoured polypropylene (Comparative Example C32).

EXAMPLES 32–41 AND COMPARATIVE EXAMPLE C33 and C34

The following Examples illustrate the effect of treating unscoured Dignitary™ 51609 (polypropylene) carpet in accordance with the method of the present invention, using colloidal silica as the inorganic additive in conjunction with various organic additives. The organic additives used include polyethylene glycols of various molecular weights, polyethylene glycol monostearate, carboxyfunctionalized polyoxyethylene glycol, and polyethylene glycol monofluoroalkyl ethers. The treatments were all applied at a treatment pH of 9 using the Spray Application and Curing Procedure. The soiling value for each treated carpet sample was determined using the one cycle "Walk-On" Soiling Test, and the hand of each treatmed carpet was measured using the Hand Test.

In Example 32, Nalco™ 2326 Colloidal Silica was applied alone at 0.75% SOC.

In Examples 33–37, 0.75% SOC Nalco™ 2326 Colloidal Silica was coapplied to carpet samples with 0.15% SOC Carbowax™ 300, 600, 4000 and 8000 Polyethylene Glycols and Carbowax™ 25000 Polyoxyethylene (the numbers representing the approximate polymer molecular weights), respectively.

In Example 38, Emerest 2662 Polyethylene Glycol 600 Monostearate (600S) was coapplied at 0.15% SOC with Nalco™ 2326 Colloidal Silica at 0.75% SOC.

In Example 39, Nalco™ 2326 Colloidal Silica was coapplied at 0.75% SOC with 0.15% SOC of PEGDA Carbonyfunctional Polyethylene Glycol.

In Examples 40 and 41, Nalco™ 2326 Colloidal Silica was applied at 0.75% SOC with 0.15% SOC of FC-170C and FC-171 Polyethylene Oxide Monofluoroalkl Ethers, respectively.

In Comparative Example C33, no treatment was applied to scoured carpet.

In Comparatiave Example C34, no treatment was applied to unscoured carpet.

The ΔE and ΔΔE values for Examples 32–41 and Comparative Examples C33 and C34 are presented in Table 6. By definition, the ΔΔE value for Comparative Example C33 was set equal to zero.

TABLE 6

| Ex. | Carpet Scoured? | 2326, % SOC | Glycol: MW | Glycol: % SOC | pH | Soiling, ΔΔE | Hand |
|---|---|---|---|---|---|---|---|
| 32 | No | 0.75 | — | — | 9 | 0.88 | Poor |
| 33 | No | 0.75 | 300 | 0.15 | 9 | 1.22 | Good |
| 34 | No | 0.75 | 600 | 0.15 | 9 | 1.52 | Good |
| 35 | No | 0.75 | 4000 | 0.15 | 9 | 0.89 | Good |
| 36 | No | 0.75 | 8000 | 0.15 | 9 | −0.05 | Good |
| 37 | No | 0.75 | 25000 | 0.15 | 9 | 0.85 | Good |
| 38 | No | 0.75 | 600S | 0.15 | 9 | −1.23 | Good |
| 39 | No | 0.75 | PEGDA | 0.13 | 9 | −0.85 | Good |
| 40 | No | 0.75 | FC-170C | 0.15 | 9 | 1.18 | Good |
| 41 | No | 0.75 | FC-171 | 0.15 | 9 | 0.29 | Good |
| C33 | Yes | — | — | — | — | 0 | N/A |
| C34 | No | — | — | — | — | 10.30 | Good |

The data in Table 6 show that coapplication of polyethylene glycols of various molecular weight with the aqueous colloidal silica treatment (Examples 33–37) improved the adherence of the treatment to the carpet, imparting a soft, dustless hand, while not significantly affecting the antisoiling performance when compared to using colloidal silica alone (Example 32). By contrast, the use of colloidal silica alone imparted a dusty feel to the carpet. In Example 36, where 8000 molecular weight polyethylene glycol was used, antisoiling performance was improved to the level of that shown by untreated, scoured carpet (Comparative Example C33). In Example 38, where polyethylene glycol 600 monostearate was used, antisoiling performance clearly surpassed the level of that shown by untreated scoured carpet. The data in Table 6 also show that treating unscoured polypropylene carpet with a combination of colloidal silica and carboxyfinctionalized polyoxyethylene glycol improved the antisoiling performance of the carpet to the point where it outperformed the untreated scoured carpet.

EXAMPLES 42–45 AND COMPARATIVE EXAMPLE C35

In Examples 42–45, unscoured samples of Dignitary™ 51609 Carpet (polypropylene) were treated with colloidal silica alone and silica grafted with homopolymerized methacrylic acid using the Spray Application and Curing Procedure. The soiling value of each treated carpet was measured using one cycle of the "Walk-On" Soiling Test.

In Examples 42–44, polymethacrylic acid-grafted Nalco™ 2326 Colloidal Silica (PMAA-2326) was applied to unscoured Dignitary™ 51609 polypropylene carpet at concentrations of 0.20, 0.29 and 0.44% SOC and at a treating solution pH of 3.5 In Example 45, the same experiment was run as in Examples 42–44, except that unmodified Nalco™ 2326 Colloidal Silica was substituted for PMAA-2326 and the pH of the treating solution was 9.

In Comparative Example C35, no treatment was applied to scoured carpet.

The ΔΔE values for Examples 42–45 and Comparative Example C35 are on scoured untreated in Table 7. By definition, the ΔΔE value for Comparative Example C35, run on scoured untreated carpet, was set equal to zero.

TABLE 7

| Ex. | Carpet Scoured? | Treating Composition | Total % SOC | % SOC SiO2 | pH | Soiling, ΔΔE |
|---|---|---|---|---|---|---|
| 42 | No | PMAA-2326 | 0.20 | 0.10 | 3.5 | 2.03 |
| 43 | No | PMAA-2326 | 0.29 | 0.15 | 3.5 | 1.07 |
| 44 | No | PMAA-2326 | 0.44 | 0.22 | 3.5 | 0.66 |
| 45 | No | Nalco ™2326 | 0.50 | 0.50 | 9 | 0.73 |
| C35 | Yes | — | — | | — | 0 |

The ΔΔE values in Table 7 show that at a lower total % SOC (and much lower $SiO_2$ % SOC), the poly-MAA grafted silica gave a comparable ΔΔE value than did the silica used alone (Example 45 vs. Example 44). Thus, the polymeric organic additive can be incorporated in the invention either grafted to an inorganic additive particle (Table 7) or separately as an aqueous polymer dispersion admixed with polymer-free colloidal inorganic additive (Table 5).

EXAMPLES 46–57 AND COMPARATIVE EXAMPLES C36–C37

In Examples 46–57, colloidal silica was coapplied with various polymeric organic additives on unscoured polypropylene carpet and the effect on soil resistance was measured. Dignitary™ 51609 Carpet (polypropylene) was treated using the Spray Application and Curing Procedure, and the soiling value of each treated carpet was measured using one cycle of the "Walk-On" Soiling Test.

In Example 46, Nalco™ 2326 Colloidal Silica was applied alone at a concentration of 0.75% SOC and at a solution pH of 9.

In Examples 47–57, the same experiment was run as in Example 46 except that various water-soluble and water-dispersible organic additives were coapplied with the Nalco™ 2326 Colloidal Silica. In Example 57, the Nalco™ 2236 level was lowered to 0.50% SOC. The treatment pH was 9 in all cases.

In Comparative Example C36, no treatment was applied to unscoured carpet.

In Comparative Example C37, no treatment was applied to scoured carpet.

The ΔΔE values for Examples 46–57 and Comparative Examples C36–C37 are presented in Table 8. By definition, the ΔΔE value for Comparative Example C37, run on scoured untreated carpet, was set equal to zero.

TABLE 8

| Ex. | Carpet Scoured? | 2326, % SOC | Polymer Used: Name | Type | % SOC | Soiling, ΔΔE | Hand |
|---|---|---|---|---|---|---|---|
| 46 | No | 0.75 | — | — | — | 0.72 | Poor |
| 47 | No | 0.75 | Spensol L-55 | polyurethane | 0.15 | 2.55 | Good |
| 48 | No | 0.75 | Rhoplex HG-74 | acrylic copolymer | 0.15 | 3.49 | Good |
| 49 | No | 0.75 | Adcote 50T-4990 | ethylene-acrylic acid copolymer | 0.15 | 2.53 | Good |
| 50 | No | 0.75 | Neocryl A-601 | acrylic polymer | 0.15 | 3.04 | Good |
| 51 | No | 0.75 | NeoRez XR-9699 | polyurethane | 0.15 | 3.63 | Good |
| 52 | No | 0.75 | NeoCryl A-6092 | acrylic polymer | 0.15 | 4.26 | Good |
| 53 | No | 0.75 | NeoCryl XA-6075 | acrylic polymer | 0.15 | 3.93 | Good |
| 54 | No | 0.75 | PVA #1 | polyvinyl alcohol | 0.075 | 3.24 | Good |
| 55 | No | 0.75 | PVA #1 | polyvinyl alcohol | 0.15 | 2.65 | Good |
| 56 | No | 0.75 | PVA #2 | polyvinyl alcohol | 0.075 | 2.84 | Good |
| 57 | No | 0.50 | PVA #2 | polyvinyl alcohol | 0.15 | 2.74 | Good |
| C36 | No | — | — | — | — | 9.49 | — |
| C37 | Yes | — | — | — | — | 0 | — |

The data in Table 8 show that all of the polymeric organic additives evaluated improved the hand of the silica treatment but at some expense to anti-soiling performance when compared to the silica alone.

EXAMPLES 58–65 AND COMPARATIVE EXAMPLE C38–C57

In Examples 58–65 and Comparative Examples C38–C57, unscoured polypropylene carpet was treated with various mixtures of colloidal silica and fluorochemical repellents to show how a combination of good anti-soiling properties and repellency to oil and water can simultaneously be achieved.

The usual Spray Application and Curing Procedure was used to apply and cure each treatment onto both unscoured and scoured Dignitary™ 51609 Carpet (polypropylene). The soiling value of each treated carpet was measured using one cycle of the "Walk-On" Soiling Test. Oil and water repellency were measured using the Oil Repellency Test and the Water Repellency Test earlier described.

The repellency and ΔΔE values for Examples 58–65 and Comparative Examples C38–C57 are presented in Table 9. By definition, the ΔΔE value for Comparative Example C57, run on scoured untreated carpet, was set equal to zero.

TABLE 9

| | Carpet | Silica: | | Fluorochemical: | | Repellency: | | Soiling: |
|---|---|---|---|---|---|---|---|---|
| Ex. | Scoured? | Name | % SOC | Name | % SOC | Oil | Water | ΔΔE |
| 58 | No | 2326 | 0.75 | — | — | F | F | 2.8 |
| 59 | No | 1056 | 0.75 | — | — | F | F | 2.9 |
| C38 | Yes | 2326 | 0.75 | — | — | F | W− | 1.1 |
| C39 | Yes | 1056 | 0.75 | — | — | 1− | W | 0.5 |
| 60 | No | 2326 | 0.75 | FC-461 | 0.10 | F | 1 | 4.4 |
| C40 | No | — | — | FC-461 | 0.10 | 1− | 1 | 12.5 |
| C41 | Yes | 2326 | 0.75 | FC-461 | 0.10 | 1− | 1 | 1.6 |
| C42 | Yes | — | — | FC-461 | 0.10 | 1 | 1 | 2.3 |
| 61 | No | 2326 | 0.75 | FC-364 | 0.10 | F | W− | 2.2 |
| C43 | No | — | — | FC-364 | 0.10 | 1− | W− | 11.4 |
| C44 | Yes | 2326 | 0.75 | FC-364 | 0.10 | F | 1 | 0.7 |
| C45 | Yes | — | — | FC-364 | 0.10 | 1.5 | 1 | 2.3 |
| 62 | No | 2326 | 0.75 | FC-C | 0.10 | 1+ | 1+ | −7.1 |
| C46 | No | — | — | FC-C | 0.10 | 1− | 1+ | 0.1 |
| C47 | Yes | 2326 | 0.75 | FC-C | 0.10 | 2 | 3 | 1.0 |
| C48 | Yes | — | — | FC-C | 0.10 | 2 | 5 | 3.7 |
| 63 | No | 2326 | 0.75 | FC-D | 0.10 | F | F | 3.1 |
| 64 | No | 1056 | 0.75 | FC-D | 0.10 | 1 | 1+ | 5.6 |
| C49 | No | — | — | FC-D | 0.10 | 1.5 | 3 | 11.3 |
| C50 | Yes | 2326 | 0.75 | FC-D | 0.10 | 1− | 1 | 1.5 |
| C51 | Yes | 1056 | 0.75 | FC-D | 0.10 | 2 | 2 | 1.7 |
| C52 | Yes | — | — | FC-D | 0.10 | 2 | 2 | 3.1 |
| 65 | No | 1056 | 0.75 | FC-E | 0.10 | 1+ | 1+ | 4.3 |
| C53 | No | — | — | FC-E | 0.10 | 1− | 1+ | 11.5 |
| C54 | Yes | 1056 | 0.75 | FC-E | 0.10 | 2 | 3 | 1.0 |
| C55 | Yes | — | — | FC-E | 0.10 | 2 | 5 | 3.7 |
| C56 | No | — | — | — | — | F | F | 11.4 |
| C57 | Yes | — | — | — | — | F | F | 0 |

The data in Table 9 show that unscoured polypropylene carpet treated with a combination of silica and fluorochemical repellent in most cases shows significantly improved resistance to soiling and oil and water repellency not exhibited by the untreated, unscoured carpet. These anti-soiling and repellency properties approach and in one case exceed those of scoured polypropylene carpet treated with the same combination.

EXAMPLES 66–69 AND COMPARATIVE EXAMPLE C58–C62

In Examples 66–69 and Comparative Examples C58–C62, unscoured solution-dyed nylon carpet was treated with Nalco™ 2326 colloidal silica as the inorganic additive and Polymer I stainblocker, FX-1373M fluorochemical repellent, and mixtures thereof as the organic additive, to show how a combination of good anti-soiling properties and repellency to oil and water can simultaneously be achieved and how these anti-soiling and repellency features are durable to a high level of foot traffic followed by repeated steam cleanings.

The usual Spray Application and Curing Procedure was used to apply and cure each treatment onto both unscoured and scoured Zeftron™ 2000 solution-dyed nylon carpet. The oil and water repellency were measured as before using the Oil Repellency Test and the Water Repellency Test. However, this time, the soil resistance of each treated carpet was measured under two different conditions. The first condition was two cycles of the "Walk-On" Soiling Test. The second condition, designed to show the durability of the treatment, was two foot-traffic cycles of the "Walk-On Soiling Test" followed by shampooing/steam cleaning using the Shampooing and Steam Cleaning Procedure, two more foot-traffic cycles and another shampooing/steam cleaning, and finally two more foot-traffic cycles.

The ΔΔE values for Examples 66–69 and Comparative Examples C58–C62 are presented in Table 10. By definition, the ΔΔE value for Comparative Example C62, run on scoured untreated carpet, was set equal to zero.

TABLE 10

| | Carpet | Silica: | | Organic Additive | | Repellency: | | Soiling (ΔΔE) After: | |
|---|---|---|---|---|---|---|---|---|---|
| Ex. | Scoured? | Name | % SOC | Name | % SOC | Oil | Water | 2 Cycles | 6 Cyc + 2 SC |
| 66 | No | 2326 | 0.75 | — | — | F | F | +1.8 | −0.6 |
| 67 | No | 2326 | 0.75 | FX-1373M | 0.05 | 1 | 2 | −2.7 | −1.4 |
| 68 | No | 2326 | 0.75 | Polymer I | 0.6 | F | F | +0.6 | −1.8 |
| 69 | No | 2326 | 0.75 | FX-1373M | 0.05 | 2 | F | −4.2 | −3.3 |
| | | | | Polymer I | 0.6 | | | | |
| C58 | No | — | — | FX-1373M | 0.05 | 1 | 2 | +4.5 | +2.1 |
| C59 | No | — | — | Polymer I | 0.6 | F | F | +2.7 | −0.3 |
| C60 | Yes | — | — | FX-1373M | 0.05 | F | 2 | −4.4 | −2.6 |
| C61 | No | — | — | — | — | F | F | +9.4 | +3.3 |
| C62 | Yes | — | — | — | — | F | F | 0 | 0 |

The data in Table 10 show that in Examples 67–69, an additive effect between the silica, the fluorochemical repellent and Polymer I occurred to give an improved anti-soiling performance, both with and without steam cleaning, relative to Example 66 when the silica was run alone. Also, oil and water repellency were achieved.

EXAMPLES 70–76 AND COMPARATIVE EXAMPLES C63–C68

In Examples 70–76 and Comparative Examples C63–C68, unscoured solution-dyed nylon carpet was treated with aqueous mixtures of a colloidal silica and a fluorochemical carpet treatment at various concentrations, and each treated carpet was evaluated for repellency to oil and water and resistance to soiling.

The usual Spray Application and Curing Procedure was used to apply and cure each treatment onto unscoured, white, solution-dyed Angelic™ nylon carpet. The oil and water repellency were measured as before using the Oil Repellency Test and the Water Repellency Test, and the anti-soiling performance was measured using two cycles of the "Walk-On" Soiling Test.

The ΔE and ΔΔE values for Examples 70–76 and Comparative Examples C63–C68 are presented in Table 11. As usual, the ΔΔE values were calculated compared to the ΔE value for scoured, untreated carpet (Comparative Example C68).

TABLE 11

| | Carpet | 2326, | FC-A, | Repellency to: | | Soiling Values: | |
|---|---|---|---|---|---|---|---|
| Ex. | Scoured? | % SOC | % SOC | Oil | Water | ΔE | ΔΔE |
| 70 | No | 1.50 | — | F | F | 10.1 | −1.2 |
| 71 | No | 0.90 | — | F | F | 13.3 | 2.0 |
| 72 | No | 0.75 | — | F | F | 13.9 | 2.6 |
| 73 | No | 0.50 | — | F | F | 15.8 | 4.5 |
| C63 | No | — | 0.90 | 1 | 1 | 12.1 | 0.8 |
| C64 | No | — | 0.30 | 2 | 1 | 14.4 | 3.1 |
| C65 | No | — | 0.15 | 2 | 1 | 16.5 | 5.2 |
| C66 | No | — | 0.07 | F | 1 | 18.5 | 7.2 |
| 74 | No | 1.35 | 0.15 | F | F | 8.9 | −2.4 |
| 75 | No | 0.75 | 0.15 | 1 | W | 10.9 | −0.4 |
| 76 | No | 0.50 | 0.07 | F | W | 11.8 | 0.5 |
| C67 | No | — | — | F | F | 23.5 | 12.2 |
| C68 | Yes | — | — | F | F | 11.3 | 0 |

The data in Table 11 show that a synergistic anti-soiling effect was demonstrated in Example 75 when silica and fluorochemical treatment were blended and applied at 0.90% total SOC as compared to being applied separately at comparable % SOC levels (see Example 71 and Comparative Example C63). Also, carpets treated with the blend showed repellency to both oil and water.

EXAMPLES 77–98 AND COMPARATIVE EXAMPLES C69 and C70

In Examples 77–98, and Comparatiave Examples C69 and C70, various unscoured polypropylene carpets were treated by spray or foam application with aqueous mixtures of colloidal silicas or modified silicas and fluorochemical treatments, and each treated carpet was evaluated for repellency to oil and water and resistance to soiling.

For spray application, the Spray Application and Curing Procedure was used to apply and cure the treatment onto unscoured carpet. For foam application, the Foam Application and Curing Procedure was used to apply and cure the treatment onto unscoured carpet.

Various silicas and modified silicas were evaluated, including unmodified silicas (Nalco™ 2326, Nalco™ 2327, Nalco™ 1056 and Ludox™ AS-40), silica grafted with polymethacrylic acid (PMAA-1042), silica blended with polyethylene oxide (Nalco™ 2326+Carbowax™ 8000), silicas having the surface modified with aminopropyl and propyl-functional silanes ($H_2N$-2326 and Pr-2326 respectively), and with hydrocarbon surfactant blended therewith (Berol 09, designated as B9). In all examples, the silica or modified silica was applied at 0.75% SOC except for Example 79, where a blend of 0.5% SOC Nalco™ 2326 and 0.10% SOC Carbowax™ 8000 was applied.

Fluorochemical treatments coapplied with the silicas and modified silicas were FC-B (adipate ester), FC-C (acrylate polymer), FC-Si (silane), FC-247 (acrylate polymer), FC-364 (urethane), FC-365 (allophanate), FC-461 (acrylic polymer), FC-1373M (urethane), and Dyetech™ 97H (acrylate polymer). In all cases, the fluorochemical treatment was applied at 0.050% SOC (500 ppm) based on fluorine.

The oil and water repellency was measured as before using the Oil Repellency Test and the Water Repellency Test, and the anti-soiling performance was measured using one cycle of the "Walk-On" Soiling Test.

The ΔΔE values for Examples 77–98 and Comparative Examples C69 and C70 are presented in Table 12. Each ΔΔE value was calculated using the corresponding scoured, untreated carpet as a reference.

TABLE 12

| | Unscoured | Appl. | Silica or | Fluoro- | Repellency: | | Soiling: |
|---|---|---|---|---|---|---|---|
| Ex. | Carpet | Method* | Mod. Silica | chemical | Oil | Water | ΔΔE |
| 77 | Dignitary ™ | Spray[1] | 2326 | FC-364 | F | W | 1.48 |
| 78 | Dignitary ™ | Spray[1] | 2326 | 97H | F | 1 | −1.05 |
| 79 | Dignitary ™ | Spray[1] | 2326+ CW8000 | FC-B | 1 | F | 1.33 |
| 80 | Dignitary ™ | Spray[1] | $H_2N$-2326 | FC-C | 1 | 2 | N/R |
| 81 | Dignitary ™ | Spray[1] | Pr-2326 | FC-461 | F | W | N/R |
| 82 | Dignitary ™ | Spray[1] | Pr-2326 + B9 | FC-461 | F | 1 | N/R |
| 83 | Dignitary ™ | Spray[1] | 2327 | FC-364 | F | W | −0.05 |
| 84 | Dignitary ™ | Spray[1] | 2327 | FC-365 | F | W | −0.32 |
| 85 | Dignitary ™ | Spray[1] | 2327 | FC-461 | F | 2 | 0.02 |
| C69 | Dignitary ™ | Spray[1] | — | FC-364 | 1− | W | 9.92 |
| C70 | Dignitary ™ | Spray[1] | — | FC-461 | 1− | 1 | 10.97 |
| 86 | Dignitary ™ | Foam[1] | 2327 | FC-365 | 2 | W | 1.5 |
| 87 | Dignitary ™ | Foam[1] | 2327 | FC-461 | 2 | 1 | −0.5 |
| 88 | Dignitary ™ | Spray[1] | 1056 | FC-247 | 1 | F | N/R |
| 89 | Dignitary ™ | Spray[1] | 1056 + B9 | FC-C | 1 | 1+ | N/R |
| 90 | Dignitary ™ | Spray[2] | PMAA-1042 | FC-Si | 1.5 | W | 0.12 |
| 91 | Dignitary ™ | Foam[2] | PMAA-1042 | FC-Si | 3 | 2 | −1.52 |

TABLE 12-continued

| Ex. | Unscoured Carpet | Appl. Method* | Silica or Mod. Silica | Fluoro-chemical | Repellency: Oil | Repellency: Water | Soiling: ΔΔE |
|---|---|---|---|---|---|---|---|
| 92 | Dignitary ™ | Foam[1] | AS-40 | FC-B | 1 | F | 5.3 |
| 93 | M0033 | Spray[1] | 2326 | FC-364 | 1− | W | −1.3 |
| 94 | M0033 | Spray[1] | 2326 | FC-461 | 1− | 2 | −2.42 |
| 95 | M0033 | Spray[1] | 2326 | 97H | 2 | 2 | −1.04 |
| 96 | Regal Heir ™ | Spray[1] | 2326 | FC-364 | F | W | −0.44 |
| 97 | Regal Heir ™ | Spray[1] | 2326 | FC-461 | F | 2 | 0.09 |
| 98 | Regal Heir ™ | Spray[1] | 2326 | 97H | 1 | 2 | 0.08 |

*Application method:
[1]One step coapplication of silica or modified silica and aqueous fluorochemical dispersion.
[2]Two step application: first step is application of silica or modified silica sol; second step is application of aqueous fluorochemical dispersion.

The data in Table 12 show that when unscoured carpet was treated with one of many combinations of a modified or unmodified silica blended with a fluorochemical treatment, the resulting treated carpet demonstrated repellency to oil and water and good antisoiling performance, as compared to untreated scoured or unscoured carpet.

EXAMPLE 99–104 AND COMPARATIVE EXAMPLES C71–C74

In Examples 99–104 and Comparative Examples C71–C74, experiments were run to show that aqueous treatments containing colloidal silica applied to unscoured polypropylene or nylon carpet do not require an oven curing cycle but instead can be allowed to cure at room temperature to give comparable excellent anti-soiling performance.

In Examples 99, 101 and 103, Nalco™ 2326 Colloidal Silica was applied at 0.75% SOC to unscoured Dignitary™ 51609 polypropylene or Zeftron™ 2000 solution-dyed nylon carpet samples using the Spray Application and Curing Procedure, where in Example 99 curing was done for 20 minutes at 120° C., while in Examples 101 and 103 curing was done for 10 minutes at 120° C.

In Examples 100, 102 and 104, the same procedure was used as in Examples 99, 101 and 103, respectively, except that instead of being cured in a forced air oven, treated samples were allowed to cure overnight (i.e., for approximately 16 hours) at room temperature.

In Comparative Example C71, unscoured polypropylene carpet was left untreated. In Comparative Example C72, scoured polypropylene carpet was left untreated. In Comparative Examples C73 and C74, unscoured solution-dyed nylon carpet was left untreated.

The ΔE soiling value for each treated and untreated carpet sample was measured using the "Walk-On" Soiling test procedure. For Examples 99 and 100 and Comparative Examples C71 and C72, 1 cycle of walk-on traffic was used. For Examples 101 and 102 and Comparative Example C73, 2 cycles of walk-on traffic were used. For Examples 103 and 104 and Comparative Example C74, 4 cycles of walk-on traffic were used.

The ΔE and ΔΔE values for Examples 99–104 and Comparative Examples C71–C74 are presented in Table 13. By definition, the ΔΔE value for Comparative Example C72 was set equal to zero.

TABLE 13

| Ex. | Carpet Scoured? | Carpet Substrate | Coll. Silica | % SOC Applied | Cure Cond: Temp. | Cure Cond: Time | Soiling Values: Cycle | Soiling Values: ΔE | Soiling Values: ΔΔE |
|---|---|---|---|---|---|---|---|---|---|
| 99 | No | Polyprop. | 2326 | 0.75 | 120° C. | 20 min. | 1 | 7.05 | −2.42 |
| 100 | No | Polyprop. | 2326 | 0.75 | R. T. | 16 hrs. | 1 | 7.03 | −2.44 |
| C71 | No | Polyprop. | — | — | — | — | 1 | 19.86 | 10.39 |
| C72 | Yes | Polyprop. | — | — | — | — | 1 | 9.47 | 0 |
| 101 | No | Nylon | 2326 | 0.75 | 120° C. | 10 min. | 2 | 6.5 | N/R |
| 102 | No | Nylon | 2326 | 0.75 | R. T. | 16 hrs. | 2 | 7.6 | N/R |
| C73 | No | Nylon | — | — | — | — | 2 | 15.0 | N/R |
| 103 | No | Nylon | 2326 | 0.75 | 120° C. | 10 min. | 4 | 10.0 | N/R |
| 104 | No | Nylon | 2326 | 0.75 | R. T. | 16 hrs. | 4 | 11.1 | N/R |
| C74 | No | Nylon | — | — | — | — | 4 | 19.1 | N/R |

The data in Table 13 show that when colloidal silica treatments were applied to either unscoured polypropylene or solution-dyed nylon, anti-soiling performance was as good with room temperature cured treatments as with oven-cured treatments.

The preceding description is meant to convey an understanding of the present invention to one skilled in the art, and is not intended to be limiting. Modifications within the scope of the invention will be readily apparent to those skilled in the art. Therefore, the scope of the invention should be construed solely by reference to the appended claims.

We claim:

1. A method for imparting soil resistance to carpet fibers, comprising the steps of:

providing carpet fibers containing at least about 0.3% by weight oil residue; and applying to the carpet fibers a composition comprising a liquid medium and at least one inorganic additive;

wherein the composition is applied to the carpet fibers with a wet pick-up of liquid medium of less than about 60% by weight.

2. The method of claim 1, wherein the liquid medium is a foam.

3. The method of claim 1, wherein the composition is applied to the carpet fibers with a wet pick-up of liquid medium of less than about 15% by weight.

4. The method of claim 1, wherein the carpet fibers contain at least about 0.5% by weight oil residue.

5. The method of claim 1, wherein the carpet fibers contain at least about 0.7% by weight oil residue.

6. The method of claim 1, wherein the oil residue is a spin finish.

7. The method of claim 1, wherein the inorganic additive is applied topically as a spray or foam.

8. The method of claim 1, wherein the inorganic additive is selected from the group consisting of the oxides of silicon, aluminum, zirconium, titanium, and tin.

9. The method of claim 1, wherein the inorganic additive is an acidic silica sol.

10. The method of claim 1, wherein the inorganic additive is a colloidal silica having a counterion selected from the group consisting of ammonium and sodium.

11. The method of claim 10, wherein the counterion is ammonium.

12. The method of claim 1, wherein the inorganic additive is colloidal silica having an average particle size less than about 75 nm.

13. The method of claim 1, wherein the inorganic additive is a basic aluminum salt having an average cation size of less than about 2 nm.

14. The method of claim 1, wherein the inorganic additive has an average particle surface area of at least about 300 $m^2/g$.

15. The method of claim 1, wherein the composition further comprises an organic additive selected from the group consisting of polyurethanes, acrylic polymers, polyvinyl alcohols, and polyethylene glycols or their derivatives.

16. The method of claim 15, wherein the organic additive is polyethylene glycol.

17. The method of claim 1, wherein the inorganic additive is a basic metal salt given by the formula $M(O)_x(OH)_yX_z$, wherein:

$$2x+y+mz=n;$$

M is a metal ion having a valence of n; and

X is the conjugate base of a solubilizing acid and has a valence of m.

18. The method of claim 17, wherein the composition is a solution, and wherein the basic metal salt is present in the solution as polynuclear metal clusters.

19. The method of claim 1, wherein the inorganic additive is a basic metal salt colloidal dispersion having an average particle size of less than about 2 nm.

20. The method of claim 1, wherein the composition further comprises a fluorochemical.

21. The method of claim 20, wherein the inorganic additive is colloidal silica.

22. The method of claim 21, wherein the silica and fluorochemical are applied at a total % SOC of at least about 0.3.

23. The method of claim 21, wherein the silica and fluorochemical are applied at a total % SOC of at least about 0.9.

24. The method of claim 21, wherein the silica and fluorochemical are applied simultaneously.

25. The method of claim 20, wherein the fluorochemical is selected from the group consisting of adipate esters, urethanes, allophanates, polyacrylates, and fluorosilanes.

26. The method of claim 25, wherein the fluorochemical is a polyacrylate or an anionic urethane.

27. The method of claim 1, wherein the composition comprises a stainblocking polymer.

28. The method of claim 27, wherein the stainblocking polymer is a blend of sulfonated novolac and acrylic resins.

29. The method of claim 1, wherein the composition further comprises a binding agent.

30. The method of claim 1, wherein the composition further comprises a polyethylene glycol or a derivative thereof.

31. The method of claim 30, wherein the polyethylene glycol has a molecular weight of at least about 4000 g/mol.

32. The method of claim 30, wherein the polyethylene glycol has a molecular weight of between about 4000 g/mol and about 8000 g/mol.

33. The method of claim 1, wherein the composition further comprises polyethylene glycol monostearate.

34. The method of claim 1, wherein the composition further comprises a carboxy functionalized polyoxyethylene glycol, and wherein the inorganic additive is colloidal silica.

35. The method of claim 1, wherein the composition comprises polymethacrylic acid.

36. The method of claim 35, wherein the inorganic additive is grafted with polymethacrylic acid.

37. A method for imparting soil resistance to unscoured polypropylene carpets manufactured with a spin finish, comprising the steps of:

providing a polypropylene carpet containing at least about 0.8% by weight spin finish; and applying to the carpet topically a composition comprising an inorganic oxide or basic metal salt, a binding agent, and a liquid medium;

wherein the inorganic additive has a particle surface area within the range of about 40 to about 600 $m^2/g$, and wherein the mixture is applied in such a way that the carpet absorbs less than about 15% liquid medium by weight.

38. A method for making a carpet, comprising the steps of:

spinning a plurality of fibers with the aid of a spin finish lubricant;

assembling the plurality of fibers into a carpet, such that at least about 0.3% by weight of the spin finish lubricant remains on the fibers; and applying to the fibers a composition comprising a liquid medium and at least one inorganic additive;

wherein the composition is applied to the carpet fibers with a wet pick-up of liquid medium of less than about 60% by weight.

39. The method of claim 38, wherein the plurality of fibers comprise polypropylene.

40. The method of claim 38, wherein the composition further comprises a fluorochemical.

41. The method of claim 40, wherein the fluorochemical is selected from the group consisting of adipate esters, urethanes, allophanates, polyacrylates, and silanes.

42. The method of claim 38, wherein the composition further comprises a composition selected from the group consisting of polyethylene glycol and the esters thereof.

43. The method of claim 38, wherein the plurality of fibers comprise polypropylene.

44. The method of claim 38, wherein the composition further comprises a stainblocking polymer.

45. The method of claim 44, wherein the stainblocking polymer comprises a resin selected from the group consisting of sulfonated novolac and acrylic resins.

46. The method of claim 38, wherein the inorganic additive is colloidal silica.

* * * * *